US008080943B2

(12) United States Patent
Yamamoto

(10) Patent No.: US 8,080,943 B2
(45) Date of Patent: Dec. 20, 2011

(54) IMAGE DISPLAY APPARATUS

(75) Inventor: Masahiko Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 12/494,371

(22) Filed: Jun. 30, 2009

(65) Prior Publication Data

US 2010/0007282 A1 Jan. 14, 2010

(30) Foreign Application Priority Data

Jul. 8, 2008 (JP) ..... 2008-177781

(51) Int. Cl.
*G09G 3/10* (2006.01)

(52) U.S. Cl. ..... 315/169.1; 315/169.4; 345/63; 345/77; 313/505

(58) Field of Classification Search .... 315/169.1–169.4; 345/66, 63, 60, 76, 77, 204, 212, 214; 313/483–512
See application file for complete search history.

(56) References Cited

U.S. PATENT DOCUMENTS 6,060,840 A * 5/2000 Foo et al. ..... 315/169.1
6,465,966 B2 * 10/2002 Konuma ..... 315/169.1
7,391,167 B2 * 6/2008 Jang et al. ..... 315/291
7,542,016 B2 * 6/2009 Kim ..... 345/74.1
2002/0008482 A1 1/2002 Konuma

FOREIGN PATENT DOCUMENTS

JP 2001-209352 A 8/2001

* cited by examiner

*Primary Examiner* — James H Cho
(74) *Attorney, Agent, or Firm* — Fitzpatrick, Cella, Harper & Scinto

(57) ABSTRACT

An image display apparatus of a present invention has a rear plate having a plurality of electron-emitting devices, a face plate having a light-emitting member, a high-voltage power source which applies a high voltage to the light-emitting member, a current detecting unit which detects an emission current from the electron-emitting devices, and a bypass capacitor. One end of the bypass capacitor is connected between the high-voltage power source and the current detecting unit, and the other end of the bypass capacitor is connected to a potential regulating electrode, and an electrostatic capacitance Cp of the bypass capacitor satisfies a following formula:

$$Cp>\in A/d$$

where $\in$: permittivity of vacuum, A: an area of the light-emitting member, and d: a distance between the rear plate and the face plate.

6 Claims, 21 Drawing Sheets

IMAGE DISPLAY APPARATUS

BACKGROUND OF THE INVENTION

1. Field of the Invention

The present invention relates to an image display apparatus.

2. Description of the Related Art

Conventionally, image display apparatuses having a plurality of electron-emitting devices are known. The electron-emitting device includes a field-emission type electron-emitting device, a metal/insulator/metal type electron-emitting device, and a surface conduction electron-emitting device. The field-emission type electron-emitting device is electron-emitting device using a phenomenon that when a strong electric field which exceeds $10^7$V/cm is generated on a surface of a solid such as metal or semiconductor in a vacuum, electrons are emitted from the solid into vacuum. Such phenomenon is caused by an increase in tunneling probability of electrons in the solid into vacuum because a vacuum level is distorted by the strong electric field. The tunneling probability of electrons in the solid into vacuum increases in an exponential manner with respect to the increase in the field strength.

The field-emission type electron-emitting device has an electrode (gate) which controls an electric field near a cathode (emitter) and a cathode surface. Since the field-emission type electron-emitting device can be miniaturized, various applications are expected. For example, the field-emission type electron-emitting device is used as an electron source, so as to be capable of being applied to the above-mentioned image display apparatuses.

Such image display apparatuses have a display panel, a driving circuit, a control circuit, a power source and a high-voltage power source.

Display panels generally have a rear plate and a face plate. The rear plate has a plurality of scanning wirings and a plurality of signal wirings arranged in a matrix, and a plurality of electron-emitting devices arranged respectively at intersection points of the scanning wirings and the signal wirings. The face plate is provided so as to be opposed to the rear plate, and has a light-emitting member which emits light due to electron collision. The face plate and the rear plate are fixed to an outer frame so that a vacuum is maintained therebetween. A getter which maintains vacuum is provided into a space surrounded by the face plate, the rear plate and the outer frame. A gap between the face plate and the rear plate is kept by a structure supporting member (spacer).

The driving circuit is a circuit which applies a voltage to the scanning wirings and the signal wirings. The control circuit is a circuit which controls the driving circuit. The power source is for supplying a power to the circuits. The high-voltage power source is for applying a high voltage to the face plate (for generating a strong electric field between the face plate and the rear plate).

The image display apparatus having the electron-emitting device is a "self light-emitting" display device in which a phosphor on the face plate emits light. For this reason, such image display apparatuses have a feature such that images whose contrast, color purity and realistic sensation are high can be displayed in bright and dark places.

In the image display apparatuses having the electron-emitting device, however, since the electron sources are independent according to pixels, image quality is deteriorated due to variation of characteristics of the electron sources in manufacturing and variation of fluctuation in characteristics caused by long-time operation (display of images).

A conventional technique from a viewpoint of such a problem is disclosed in Japanese Patent Application Laid-Open No. 2001-209352. An image display apparatus disclosed in Japanese Patent Application Laid-Open No. 2001-209352 has an ampere meter which detects an amount of current flowing in a high-voltage power source. The image display apparatus disclosed in Japanese Patent Application Laid-Open No. 2001-209352 stores an amount of the current flowing in the high-voltage power source into the memory in synchronization with timing (timing pulse) at which a driving circuit applies a voltage, and corrects a voltage to be applied to the electron-emitting devices (electron sources) based on the stored amount of the current.

SUMMARY OF THE INVENTION

Normally in the image display apparatuses, a variation in luminance among the pixels should be kept within a few percentages in order to keep display quality which does not cause discomfort to a viewer. However, even when the voltage to be applied to the electron-emitting device is corrected based on the amount of the current flowing in the high-voltage power source like the image display apparatus disclosed in Japanese Patent Application Laid-Open No. 2001-209352, a deterioration in the image quality cannot be sufficiently repressed. Concretely, the electric current flowing in the high-voltage power source includes a high-frequency current (noise component) as well as an emission current caused by electrons emitted from the electron source (electrons which collide with the light-emitting member). The high-frequency current is, for example, an electric current caused by noises such as switching noise generated in the high-voltage power source, and an oscillation current caused by coupling of an inductance component and a capacitance component which are parasitic on the inside of the high-voltage power source and between the high-voltage power source and the display panel. For this reason, the emission current (or an electric current corresponding to the emission current) cannot be accurately measured for a short time, and thus the deterioration in image quality cannot be sufficiently repressed.

In order to solve the above problems, it is an object of the present invention to provide an image display apparatus which is capable of accurately estimating a fluctuation in an emission current and sufficiently repressing the deterioration in image quality.

The image display apparatus according to the present invention includes: a rear plate which has a plurality of scanning wirings and a plurality of signal wirings arranged in a matrix and a plurality of electron-emitting devices arranged respectively at intersection points of the scanning wirings and the signal wirings; a face plate which has a light-emitting member for emitting light due to collision of electrons; a high-voltage power source which applies a high voltage to the light-emitting member; a current detecting unit which is connected between the light-emitting member and the high-voltage power source in order to detect an emission current from the electron-emitting devices; a control unit which controls a voltage to be applied to the electron-emitting devices based on detection result of the current detecting unit; and a bypass capacitor, wherein one end of the bypass capacitor is connected between the high-voltage power source and the current detecting unit, and the other end of the bypass capacitor is connected to a potential regulating electrode, wherein an electrostatic capacitance Cp of the bypass capacitor satisfies a following formula:

$$Cp>\in A/d$$

where ∈: permittivity of vacuum,

A: an area of the light-emitting member, and d: a distance between the rear plate and the face plate.

According to the present invention, the image display apparatus, which is capable of accurately estimating a fluctuation in an emission current and sufficiently repressing the deterioration in image quality, can be provided.

Further features of the present invention will become apparent from the following description of exemplary embodiments with reference to the attached drawings.

BRIEF DESCRIPTION OF THE DRAWINGS

FIG. 20 is a diagram illustrating one example of burn-in; and

DESCRIPTION OF EMBODIMENTS

Figure 1:
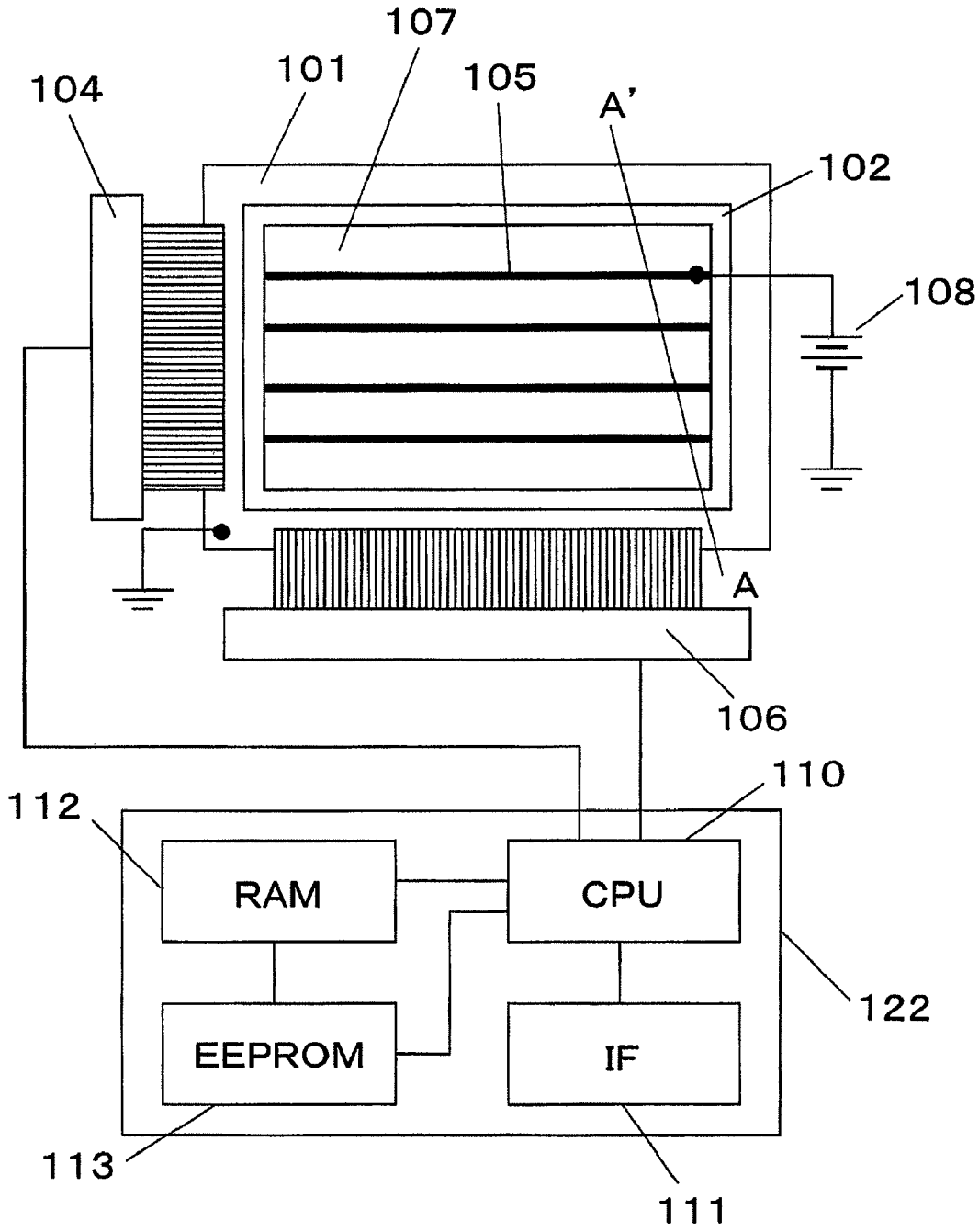
FIG. 1 is a diagram illustrating one example of an image display apparatus to which the present invention can be applied.

An image display apparatus according to an embodiment of the present invention is described below with reference to the drawings. Like components are denoted by like reference symbols in the drawings.

<Conventional Image Display Apparatus>

One example of a constitution of an image display apparatus to which the present invention can be applied, namely, a conventional image display apparatus having an electron-emitting device is described with reference to FIG. 1. In FIG. 1, a rear plate 101, a face plate 102, a spacer 105, and a light-emitting member 107 are provided.

Figure 2:
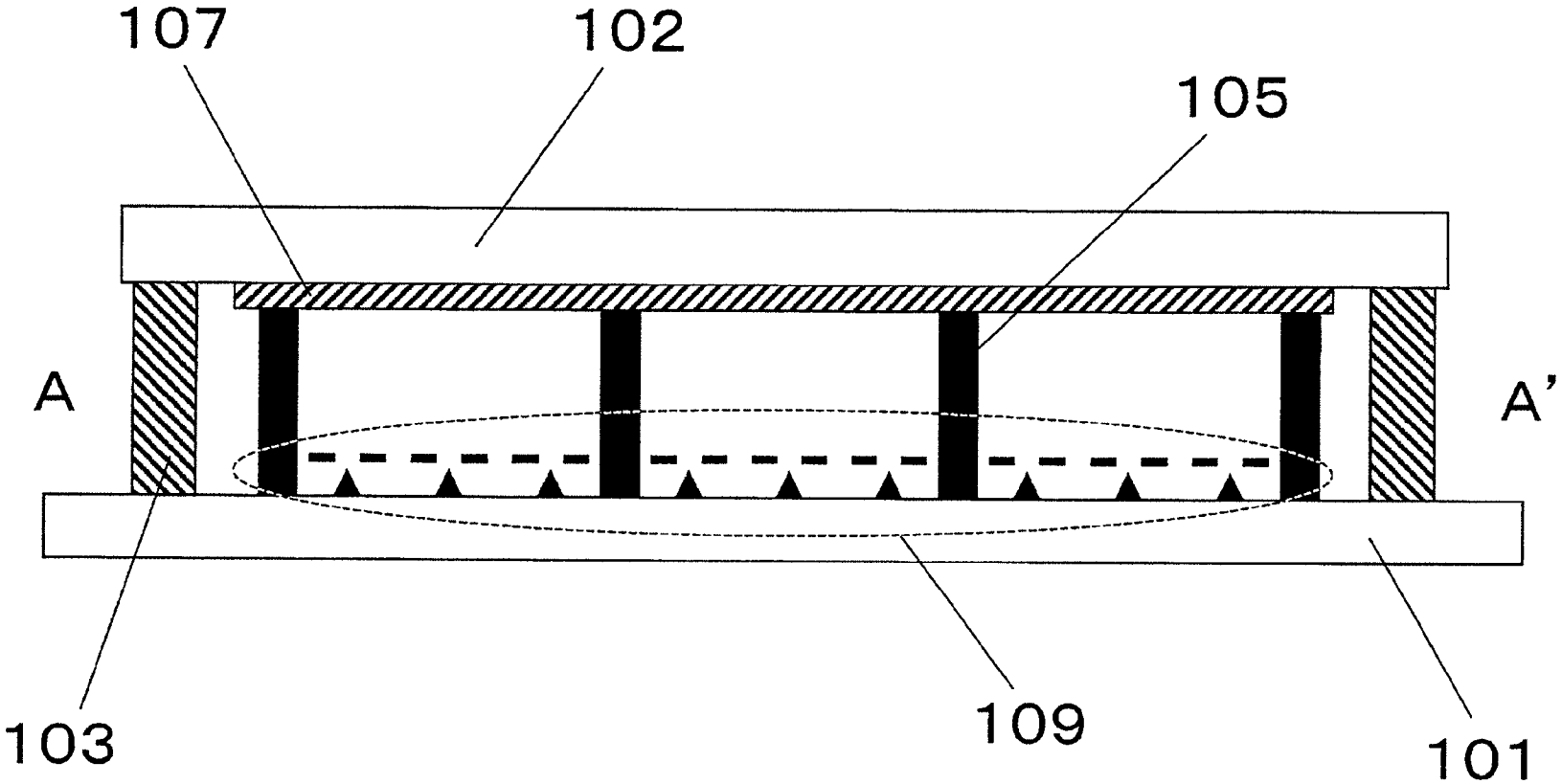
FIG. 2 is a cross-sectional view taken along line A-A' of FIG. 1.

A size of the rear plate 101 is approximately equivalent to the face plate 102, or is slightly larger than the face plate 102. FIG. 2 is a cross-sectional view taken along line A-A' of FIG. 1. As shown in FIG. 2, the rear plate 101 and the face plate 102 are opposed to each other with a gap of a few hundred μ to a few mm, and their outer peripheral portions are fixed to an outer frame 103. A space surrounded by the rear plate 101, the face plate 102 and the outer frame 103 is evacuated, and vacuum of the space is kept by a getter (gas adsorbent), not shown. The spacer 105 as an atmospheric pressure resistant structure is provided between the face plate 102 and the rear plate 101, so that the gap therebetween is maintained.

Figure 3:
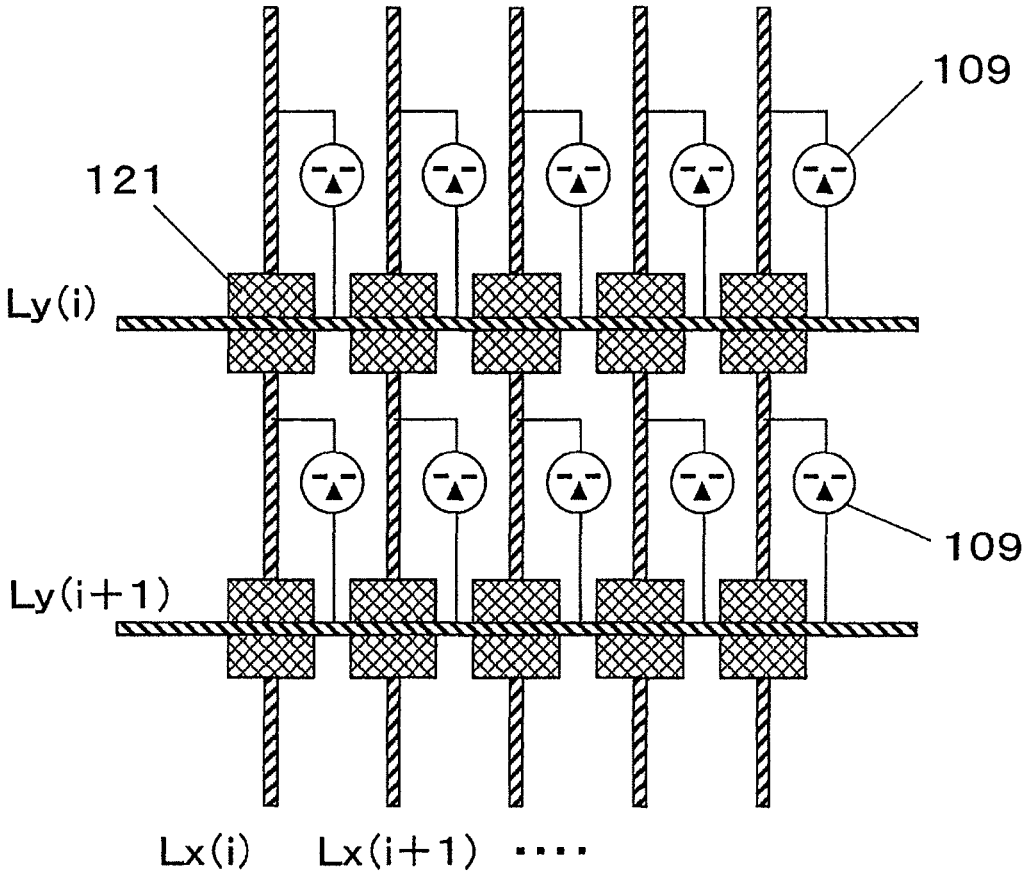
FIG. 3 is a diagram illustrating one example of arrangements of scanning wirings, signal wirings and electron sources on a rear plate.

The rear plate 101 has a plurality of scanning wirings and a plurality of signal wirings arranged in a matrix, and a plurality of electron-emitting devices (electron sources) arranged respectively at intersection points of the scanning wirings and the signal wirings on a surface on (opposed to) the face plate 102 side. The electron sources are connected to the scanning wirings and the signal wirings, and electrons are emitted from the electron sources which are connected to the scanning wirings and the signal wirings to which a selection voltage is applied. An arrangement state of the wirings and the electron sources is shown in FIG. 3. In FIG. 3, reference letter Ly represents a scanning wiring (Y-directional wiring), reference letter Lx represents a signal wiring (X-directional wiring), reference numeral 121 represents an insulating layer which separates (insulates) the scanning wiring and the signal wiring, and reference numeral 109 represents an electron source (electron-emitting device).

As shown in FIG. 2, the face plate 102 has a light-emitting member 107 which emits light due to collision of the electrons on its surface on the rear plate 101 side. The spacer 105 is provided so as to touch an electron source unformed portion of the rear plate 101 (portion on which the electron sources are not formed) and the light-emitting member.

A portion composed of the above components is called as a display panel.

In FIG. 1, a Y driver 104, an X driver 106, and a high-voltage power source 108 are provided. The Y driver 104 is a driving circuit which applies a voltage to the scanning wirings. The X driver 106 is a driving circuit which applies a voltage to the signal wirings. The high-voltage power source 108 is a power source which applies a high voltage to the face plate 102 (concretely, the light-emitting member 107) (generates a strong electric field between the face plate 102 and the rear plate 101 (light-emitting member 107 and the electron sources 109)). When the high-voltage power source 108 applies a high voltage (positive bias) to the light-emitting member 107, the emitted electrons are accelerated towards the light-emitting member 107.

The Y driver 104 and the X driver 106 are connected to a computing unit (CPU) 110 on a control substrate 122 as shown in FIG. 1. An input interface (I/F) 111 of a video source (video signal), a memory (RAM) 112 and a flash memory (EEPROM) 113 as well as the CPU 110 are provided onto the control substrate 122. A video signal input from the I/F 111 is converted into a driving signal for controlling the driving states of the Y driver 104 and the X driver 106 by means of the CPU 110. The driving states of the Y driver 104 and the X driver 106 are controlled by the driving signal transmitted from the CPU 110. For example, the driving signal controls values of voltages to be applied to the scanning wirings and the signal wirings. The CPU 110 can see the RAM 112 and the EEPROM 113 at the time of an arithmetic process.

A preferable embodiment of the components is described in detail below.

(Constitution of the Rear Plate)

The constitution of the rear plate 101 is described in detail.

The rear plate 101 is an insulating flat plate. Concretely, an insulating or high-resistance material may be used as a material of the rear plate 101. Examples of the rear plate 101 are a substrate mainly containing $SiO_2$ such as quartz glass, sodium glass, soda-lime glass, borosilicate glass or phosphorus glass, an insulating oxide substrate such as an $Al_2O_3$ substrate, and an insulating nitride substrate such as an AlN substrate. The rear plate 101 preferably has a dielectric strength voltage of $10^7$ V/cm or more near its surface.

The scanning wirings and the signal wirings can be formed by dry process such as a metal evaporation method, a CVD method, or a sputtering method, a wet process such as electrolytic plating or nonelectrolytic plating, a thick film printing method, an offset printing method or metal foil laminating method. The scanning wirings and the signal wirings preferably have sufficiently low resistance, and the resistance value is preferably about a few Ω/m to a few kΩ/m.

The display panel is preferably driven by "line-sequential driving" for simultaneously driving the electron sources provided on one scanning wiring. In this case, an amount of current flowing in the scanning wirings at the time of driving the display panel becomes large with respect to an amount of current flowing in the signal wirings (multiplied by a number of pixels of the scanning wirings in a lengthwise direction). For this reason, the resistance of the scanning wirings is preferably sufficiently lower than the resistance of the signal wirings. In general, the scanning wirings are formed so as to extend to a horizontal direction on a screen, and the signal wirings are formed so as to extend to a vertical direction on the screen, but their directions may be altered.

Figure 4:
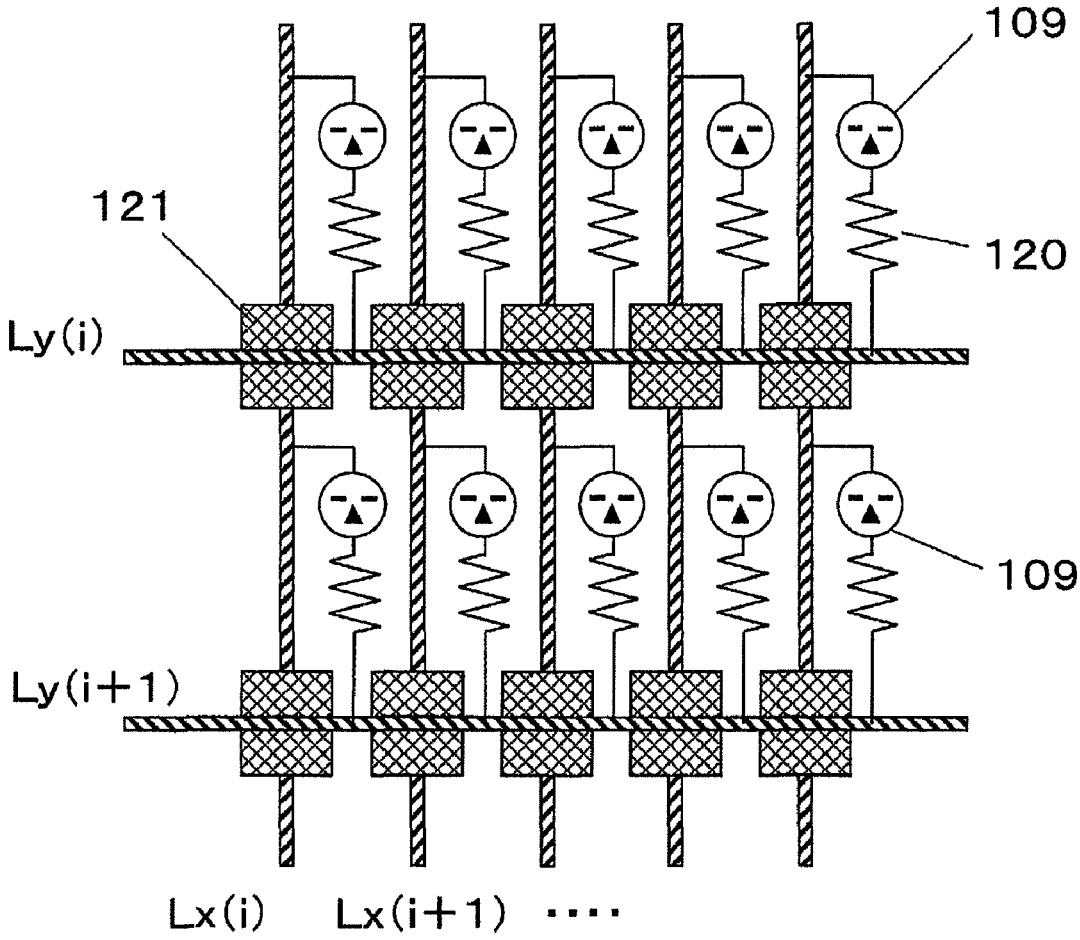
FIG. 4 is a diagram illustrating one example of arrangements of the scanning wirings, signal wirings and the electron sources on the rear plate.

As shown in FIG. 4, the electron sources are preferably connected to the scanning wirings or the signal wirings via the current limiting resistors 120. When the current limiting resistors are inserted between the electron sources and the wirings, if sudden discharge occurs between the rear plate and the face plate, inflow of a discharge current into the devices can be prevented. Further, a load on the driving circuit in the case where short circuit occurs in the devices can be reduced.

(Constitution of the Electron-Emitting Device)

A constitution of the electron source (electron-emitting device) according to the embodiment is described in detail below. Concretely, as an example of the electron-emitting device according to the embodiment, a Spindt-type electron-emitting device (one example of a field-emission type electron-emitting device) and a surface conduction electron-emitting device are described.

Figure 5:
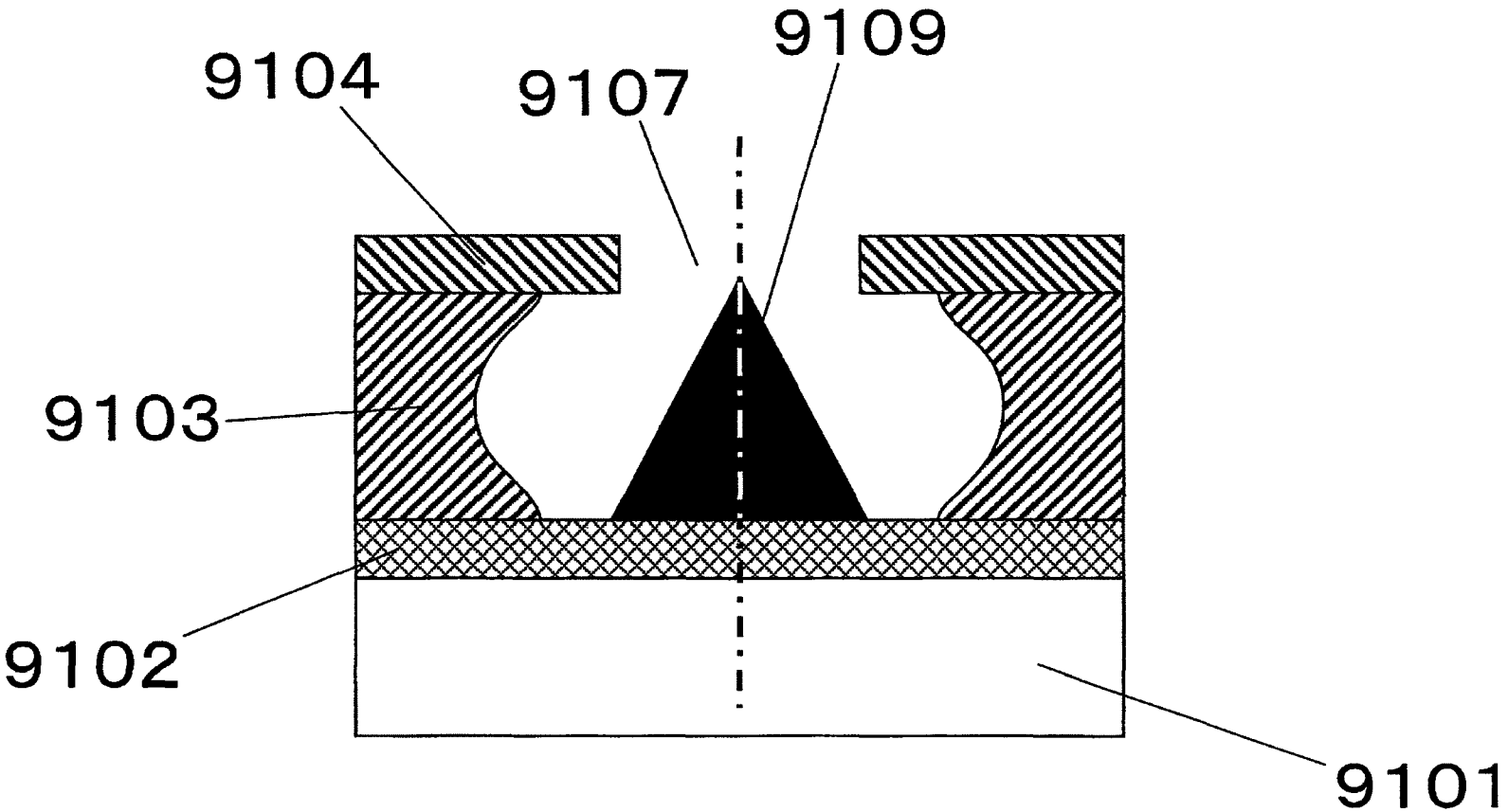
FIG. 5 is a cross-sectional pattern diagram illustrating a Spindt-type electron-emitting device.

The Spindt-type electron-emitting device is described first. FIG. 5 is a cross-sectional pattern diagram of the Spindt-type electron-emitting device. In FIG. 5, an insulating substrate 9101, a conductive layer 9102, an insulting layer 9103, a gate electrode 9104, a gate opening 9107, and an emitter electrode 9109 are provided. The emitter electrode has a conical shape, and a curvature radius of its front end portion is a few nm to a few hundred nm. The Spindt-type electron-emitting device has an axisymmetric structure with respect to the center axis of the cone of the emitter electrode, and a radius of the gate opening 9107 is few dozens nm to a few μm. The insulating substrate 9101 may be the rear plate or another substrate different from the rear plate. As the insulating substrate 9101, an insulating or high-resistance material may be used similarly to the rear plate.

In the Spindt-type electron-emitting device, electrons are emitted from the conical emitter front end portion by a tunneling effect. Concretely, an electric potential of the gate electrode is positively biased to about ten through few dozens V with respect to the emitter electrode, so that a strong electric field which exceeds $10^7$ V/cm is generated on the emitter front end portion (field concentration effect). The electrons are emitted by the field concentration effect.

Figure 6:
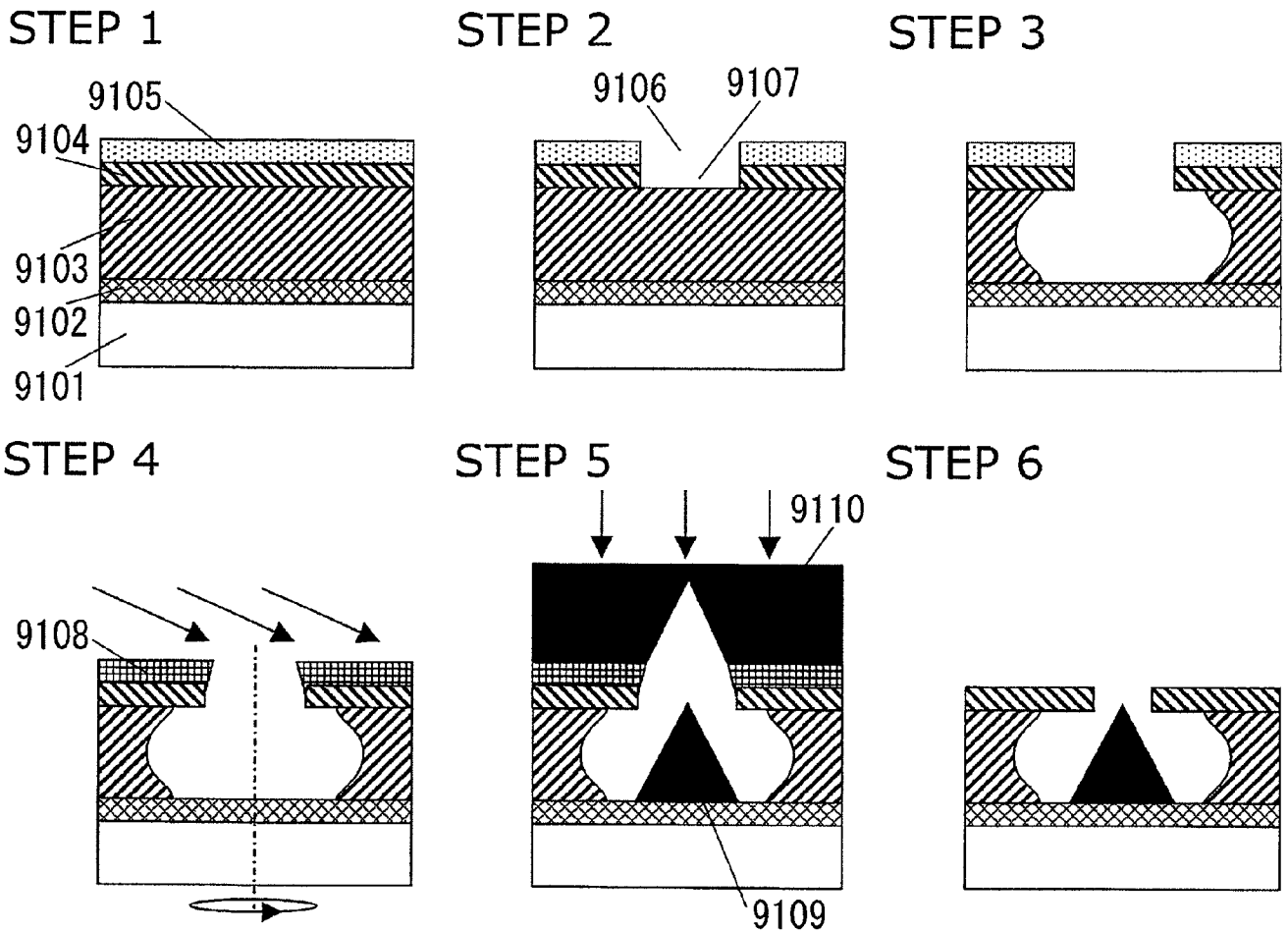
FIG. 6 is a diagram illustrating one example of a method for manufacturing the Spindt-type electron-emitting device.

One example of the method of manufacturing the Spindt-type electron-emitting device is described below with reference to FIG. 6.

(Step 1)

The conductive layer 9102, the insulating layer 9103 and the gate layer 9104 are sequentially deposited on the insulating substrate 9101. Thereafter, the gate layer is coated with a resist layer 9105. Metal such as Ti or Mo can be suitably used as the conductive layer 9102, and an insulating compound such as $SiO_2$ or SiN can be suitably used as the insulating layer 9103. Metal such as Nb can be suitably used as the gate layer 9104. The conductive layer 9102, the insulating layer 9103 and the gate layer 9104 are suitably deposited by the sputtering method, the CVD method or the like. A resistive layer, not shown, may be provided between the conductive layer and the insulating layer 9103.

(Step 2)

The resist layer 9105 is exposed so that an opening pattern 9106 is provided. The gate layer 9104 is partially removed by etching with the residual resist layer 9105 being used as a mask. As a result, an opening (gate opening 9107) is formed on the gate layer 9104. The dry etching such as RIE or CDE, or the wet etching using acid or alkali is suitably used for the etching of the gate layer 9104.

(Step 3)

The insulating layer 9103 is removed by etching until the conductive layer 9102 is exposed. As a result, an opening is formed on the insulating layer 9103. An isotropic etching such as CDE or wet etching is generally used for the etching of the insulating layer 9103. After the insulating layer 9103 is etched, the resist layer 9105 (mask) is removed.

(Step 4)

While the insulating substrate 9101 is being rotated (naturally, the other layers are being rotated simultaneously), a sacrificial layer 9108 is deposited on the gate layer 9104 by oblique evaporation. This is because the sacrificial layer 9108 is not formed in the opening (concretely, the exposed conductive layer 9102). Metal such as Al can be used as a material of the sacrificial layer 9108.

(Step 5)

An emitter material is deposited on the exposed conductive layer 9102 and the gate layer 9104. A flying direction of the emitter material is approximately vertical to the surface of the conductive layer 9102. Since the opening is gradually narrowed by a surface diffusion effect, the emitter material has a shape shown by a reference number 9110 on the sacrificial layer 9108. As a result, a conical emitter 9109 is formed on the conductive layer 9102. High-melting point metal such as Mo, Ta, W, Nb, Zr or Ir is generally used as the emitter material.

(Step 6)

After the emitter is formed, the sacrificial layer is removed by wet etching together with an excessive emitter material 9110. The Spindt-type electron-emitting device is manufactured by the above steps.

The surface conduction electron-emitting device is described below. In the surface conduction electron-emitting device, a voltage is applied between two electrodes (anode and cathode) separated by a nanoslit, so that electrons are emitted.

Figure 7:
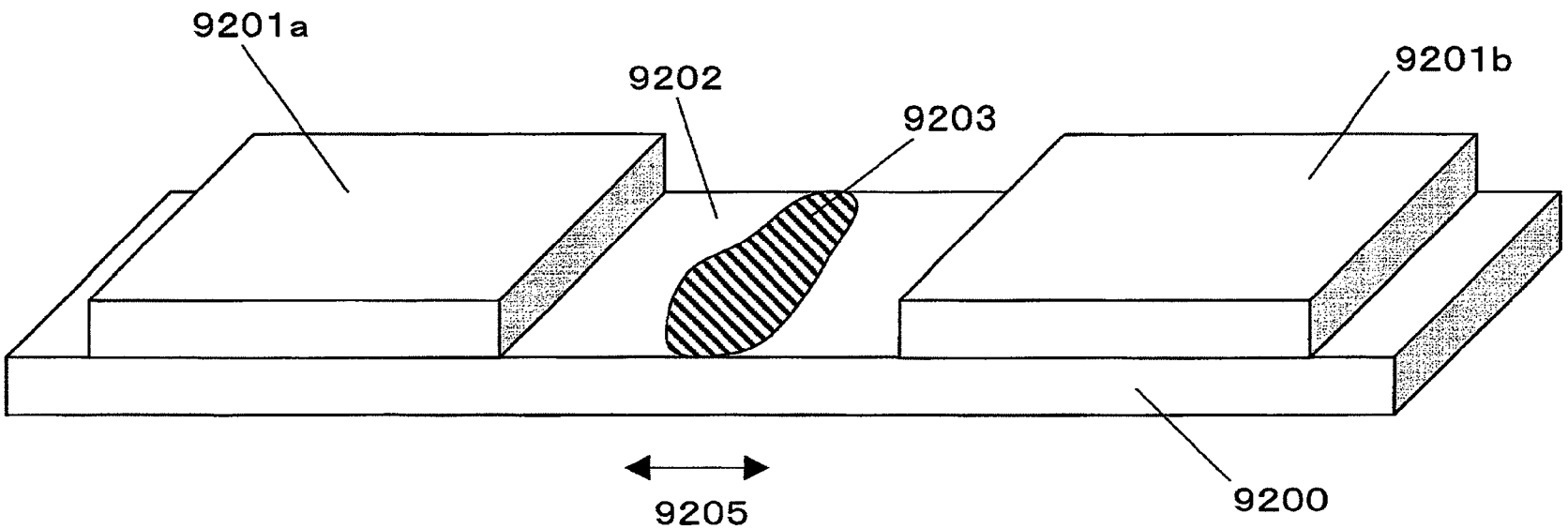
FIG. 7 is a perspective view schematically illustrating a surface conduction electron-emitting device.

FIG. 7 is a perspective view schematically illustrating the surface conduction electron-emitting device. The surface conduction electron-emitting device has a pair of metal electrodes 9201*a* and 9201*b* separated from each other on the insulating substrate 9200. A metal film 9202 which is divided into two by a microslit is formed between the electrodes 9201*a* and 9201*b*. The divided metal films 9202 are connected to the electrodes 9201*a* and 9201*b*, respectively. A sedimentary layer 9203 is formed on a microslit portion of the metal film 9202. In FIG. 7, reference numeral 9205 shows a width of the microslit of the metal film 9202, and the width 9205 is about 0.1 μm to 10 μm. The insulating substrate 9200 may be the above rear plate, or may be another substrate different from the rear plate. An insulating or high-resistance material may be used as the insulating substrate 9200 similarly to the rear plate.

One example of a method of manufacturing the surface conduction electron-emitting device is described below.

A pair of flat metal electrodes 9201*a* and 9201*b* separated from each other is formed on the insulating substrate 9200. The metal film 9202 which is sufficiently thinner than the electrodes 9201*a* and 9201*b* and has sufficient thickness for electric conduction is formed between the electrodes 9201*a* and 9201*b*.

The electrodes 9201*a* and 9201*b* are energized so that Joule heat is generated on the metal film. As a result, the metal film 9202 is partially fusion-cut and broken so as to be discontinued. That is to say, the microslit is formed on the metal film 9202. When the metal film 9202 is discontinued, the resistance between the electrodes 9201*a* and 9201*b* is heightened. The discontinuing process by the energizing to the metal film 9202 is called as "Basic forming (B forming)".

The device formed in such a manner is subject to an "Adsorption-assisted forming (A forming)" process. The A forming is the process for applying a voltage of 20 V or less between the electrodes 9201*a* and 9201*b* in vacuum containing carbon hydride so as to form the sedimentary layer 9203 on the microslit portion. When several minutes elapse from the starting of the A forming, the resistance between the electrodes 9201*a* and 9201*b* reduces, and the electric current flowing between the electrodes 9201*a* and 9201*b* increases. The A forming is executed until a desired current flows. After the A forming, the devices are energized, so that the electrons are emitted and also light emission can be observed. That is to say, the surface conduction electron-emitting device is manufactured through the above steps. It is reported from the result of spectrum analysis of the light emission that the sedimentary layer 9203 formed on the microslit portion is a graphitized carbon film. Further, it is reported that the nanoslit is formed on the sedimentary layer 9203 similarly to the metal film 9202.

In the electron-emitting device described above, a threshold Vth of the electron emission (voltage necessary for emitting electrons) can be defined. For example in the field-emission type electron-emitting device, an electron emission characteristic (probability of emission of electrons into vacuum) increases in an exponential manner with respect to an increase in the field strength on a surface of an electron-emitting portion. For this reason, the threshold Vth of the electron emission determined by a shape and a material of the device can be defined. When a voltage (voltage to be applied to the device) is adjusted to around the voltage Vth, an amount of the electron emission can be adjusted by several digits. For example, when the electron sources are provided to the intersection points of the scanning wirings and the signal wirings, respectively, a selection voltage Vy which satisfies a relationship $|Vy|<Vth$ may be applied to the scanning wirings, and a selection voltage Vx which satisfies a relationship $Vx-Vy>Vth$ may be applied to the signal wirings. As a result, electrons can be emitted only from the electron sources connected to the scanning wirings and the signal wirings to which such selection voltages are applied. The electron sources described above can be suitably used in a passive matrix driven-type image display apparatus having a simple constitution.

(Constitution of the Face Plate)

A constitution of the face plate 102 is described in detail below.

The face plate 102 is a transparent and insulating substrate, and has a light-emitting member which emits light by means of electron-beam excitation, on its surface (the surface on the rear plate side). The light-emitting member is kept in an electric potential, which is higher than the electric potential of the rear plate by a few kV to a several dozen kV, by the high-voltage power source provided to the outside of the display panel. A pixel area having a phosphor layer is formed on the light-emitting member.

Figure 8:
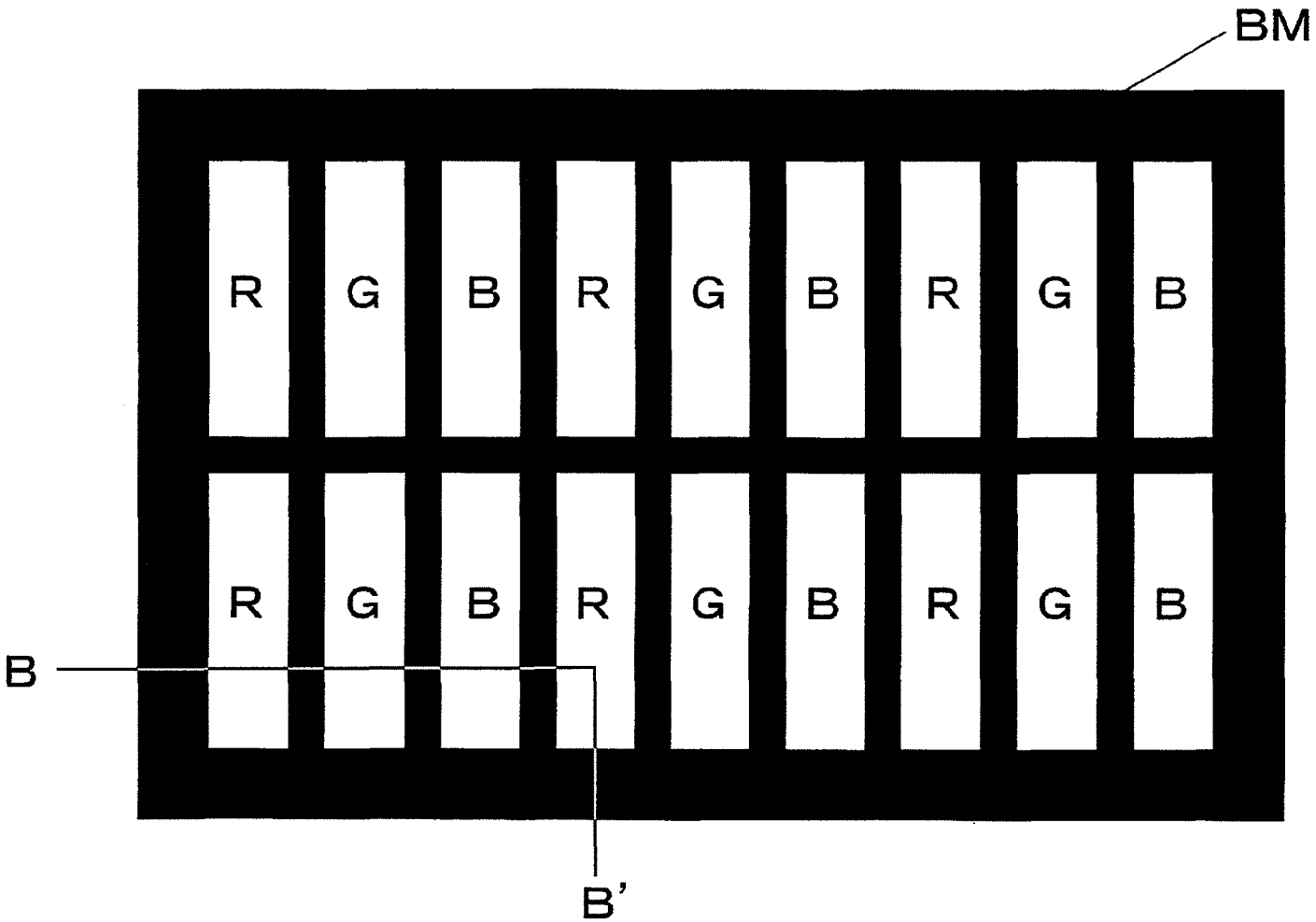
FIG. 8 is a diagram illustrating a partial constitution of a pixel area.

FIG. 8 is a diagram illustrating a partial constitution of the pixel area. In FIG. 8, reference letters R, G and B represent sub-pixels corresponding to three primary colors including red, green and blue. As shown in FIG. 8, the respective sub-pixels are preferably separated by a black matrix (BM). As a results color mixing of light emission colors (light emission of the phosphor layers) can be prevented, and at the same time reflection of an outside light can be repressed. This state is shown in FIG. 9.

Figure 9:
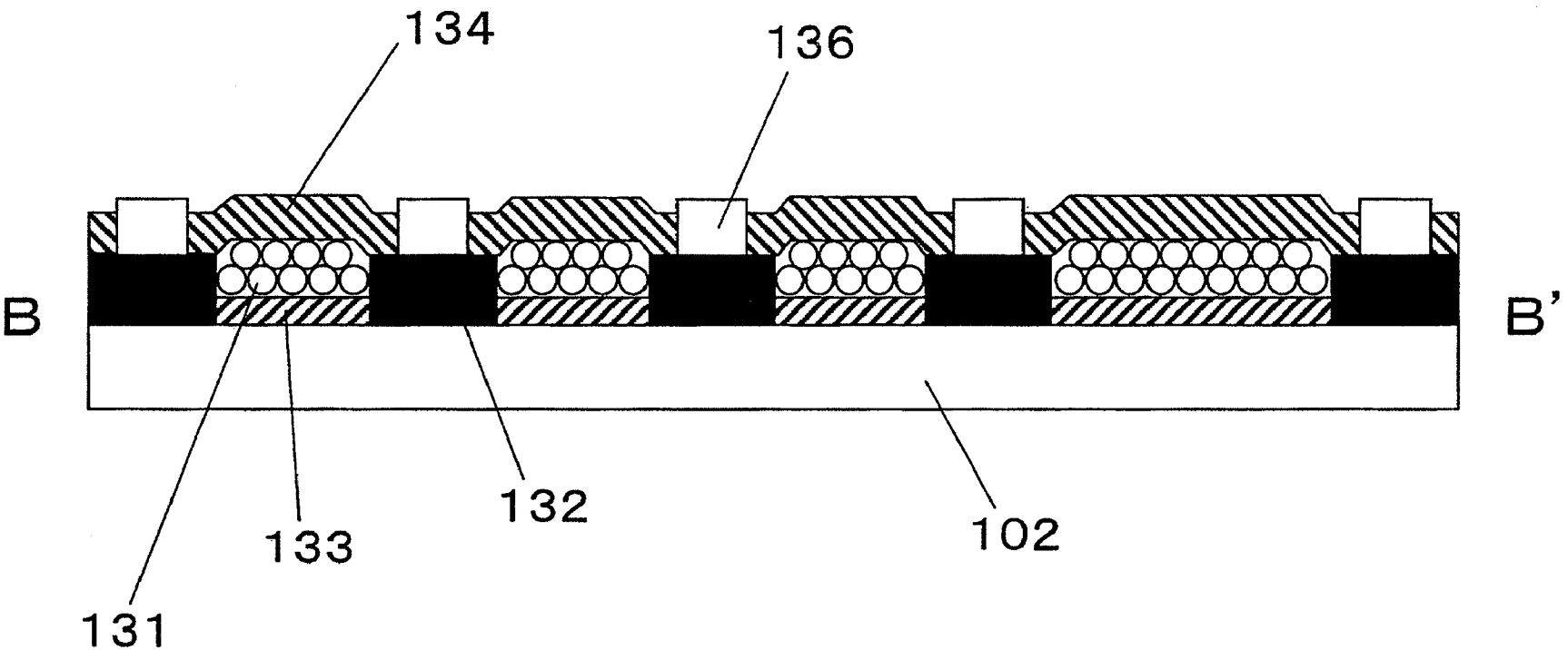
FIG. 9 is a cross-sectional view taken along line B-B' of FIG. 8.

FIG. 9 is a cross-sectional view taken along line B-B' of FIG. 8. FIG. 9 illustrates the face plate 102, a phosphor layer (Ph) 131 and a black matrix layer (BM) 132. A material of the face plate 102 is preferably the same as that of the rear plate. As a result, warpage of the display panel due to temperature can be repressed. As a material of the phosphor layer 131 (phosphor material), materials which vary according to R, G and B are used (described in detail later). As a material of the black matrix layer 132, a material containing a black material such as carbon black or iron oxide can be used. Concretely, the black matrix layer 132 preferably has a high optical absorption factor with respect to visible light of 400 nm to 760 nm in order to repress the color mixing of light emission colors and the reflection of outside light.

In an example of FIG. 9, a metal back layer (MB) 134 is provided on the rear plate side of the phosphor layer 131, and a color filter layer (MF) 133 is provided on the face plate side of the phosphor layer 131. The color filter layer 133 is provided, so that color purity of light emission color is heightened, and the reflection of outside light can be further repressed. In the example of FIG. 9, the color filter layer 133 is divided by the black matrix (BM) 132 similarly to the phosphor layer 131.

It is preferable that the phosphor layers are electrically connected by a high-resistance member. As a result, an electric current which flows among the phosphor layers can be limited. Concretely, when sudden discharge occurs between the face plate and the rear plate, a negative feedback can be added to the discharge current, so that a divergent increase in the discharge current can be repressed. For this reason, it is preferable that the black matrix layer 132 has electrically high resistance, and that the metal back layer 134 is divided by the high-resistance member correspondingly to the phosphor layer 131. Reference numeral 136 in FIG. 9 represents a high-resistance portion (HR) which divides the metal back layer correspondingly to the phosphor layer 131.

In this embodiment, the phosphor layer 131, the black matrix layer 132, the color filter layer 133, the metal back layer 134 and the high-resistance portion 136 are integrally called as the light-emitting member. The high-voltage power source applies a high voltage to the metal back layer 134. As a result, electrons which enter the phosphor layer 131 (transmits through the metal back layer 134) can be collected. The metal back layer 134 further has a function for reflecting emitted light from the phosphor layer 131 towards the face plate.

The electrons emitted from the electron sources transmit through the metal back layer 134 and collide with the phosphor layer 131. For this reason, it is preferable that the metal back layer 134 has high electron beam transmittance. As a result, arriving efficiency of the electrons to the phosphor layer 131 can be heightened. Further, it is preferable that the surface of the metal back layer 134 on the side of the phosphor layer 131 is smooth and has high optical reflectance. As a result, the emitted light of the phosphor layer 131 can be reflected to the outside of the display panel efficiently. Since the electron beam transmittance is approximately inversely proportional to a specific gravity of the material, light metal such as aluminum can be suitably used as the material of the metal back layer 134. Since the electron beam transmittance reduces in an exponential manner with respect to an increase in the film thickness of the metal back layer 134, the film thickness of the metal back layer 134 may be basically thin. However, when the film thickness is made to be extremely thin, occurrence frequency of a pinhole increases, and thus the film thickness of the metal back layer 134 is suitably about 100 nm.

A substance obtained by laminating phosphor particles with diameter of about a few μ can be used as the phosphor layer 131. Europium activated yttrium oxide ($Y_2O_3$:Eu) or europium activated yttrium oxysulfide ($Y_2O_2S$:Eu) can be used as the red phosphor. Copper/aluminum activated zinc sulfide (ZnS:Cu, Al) or terbium activated yttrium silicate ($Y_2SiO_5$:Tb) can be used as the green phosphor. Silver/chlorine activated zinc sulfide (ZnS:Ag, Cl), or silver/aluminum activated zinc sulfide (ZnS:Ag, Al) can be used as the blue phosphor.

Concretely, the phosphor layer 131 preferably has high light-emission efficiency in pulse excitation of high energy density of about 1 mJ/cm$^2$, and its afterglow time of the light emission (1/100 times of attenuation time) is preferably about 4 ms. It is preferable that the phosphor layer 131 has high color purity, namely, it emits light with a wavelength for selectively exciting visual cells of corresponding colors in visual cells in retina. Concretely, it is preferable that the red (R) phosphor layer has an light-emission peak at 640 nm or more, the green (G) phosphor layer has an light-emission peak at around 520 nm, and the blue (B) phosphor layer has an light-emission peak at 460 nm or less. Further, it is preferable that a reduction in the light-emission efficiency of the phosphor layer 131 due to long-time electron beam emission is small, and a fluctuation in the light-emission efficiency due to temperature change is small. However, phosphors having all these advantages are not actually present. For example, the red phosphor $Y_2O_2S$:Eu has an inferior temperature characteristic (the fluctuation in the light-emission efficiency due to the temperature change is not much small), but has high color purity. On the other hand, $Y_2O_3$: Eu has an inferior light emission color characteristic. Further, a surface protective layer such as an oxide film may be provided onto the surface of the phosphor layer 131. As a result, a change in the light-emission efficiency with time can be repressed.

Figure 10:
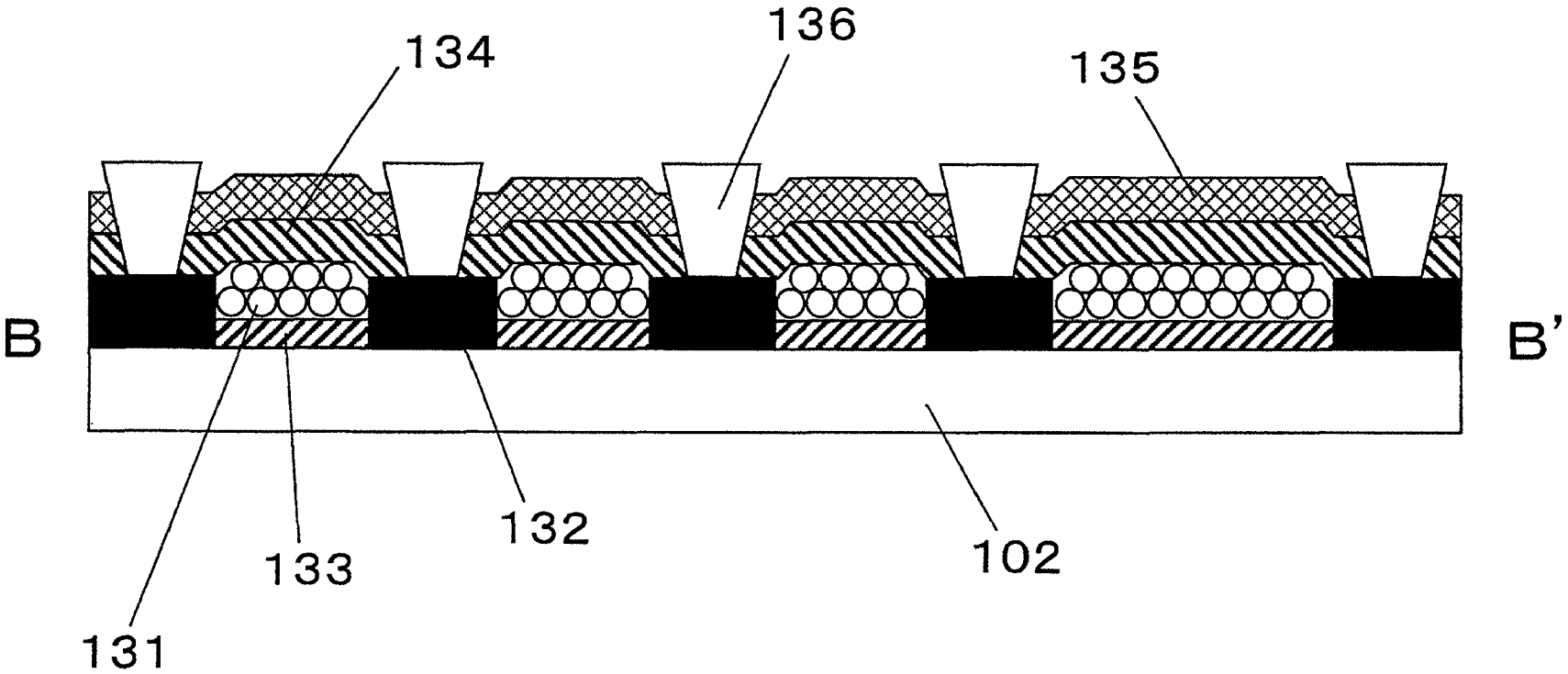
FIG. 10 is a pattern diagram illustrating a cross section of a face plate when a getter layer is provided.

A getter layer is preferably provided onto the metal back layer 134 (on the rear plate side). The getter layer has a function for adsorbing and evacuating residual gas and emitted gas in the display panel. As a result, the inside of the display panel can be maintained in high vacuum. A metal film having high reactivity can be used as the getter layer. Concretely, an evaporation film made of barium (evaporable getter) or a thin film made of titanium, vanadium or zirconium (non-evaporable getter (NEG)) can be suitably used. FIG. 10 is a pattern diagram illustrating a cross section of the face plate in the case where the getter layer is provided. In an example of FIG. 10, the high-resistance portion (HR) has a taper shape such that its width becomes wide on the rear plate side. As a result, when the getter layer is deposited on the metal back layer 134, short circuit between the sub-pixels (between the metal back layers 134) can be prevented.

(Constitution of the Spacer)

A constitution of the spacer 105 is described in detail below.

In the example of FIG. 1, four plate-shaped spacers which extend to the horizontal direction on the screen are shown. As shown in FIG. 3, the spacers 105 are provided so as to touch the rear plate and the face plate (accurately, the light-emitting member) in the display panel.

The spacers 105 are provided so that interference with an image does not occur. That is to say, the spacers 105 are provided so as not to overlap with the phosphor layers and the electron sources on a surface parallel with the light-emitting member. The spacers 105 preferably touch the black matrix on a rear side of the face plate and a position which avoids the electron sources on the rear plate side (on the signal wirings and scanning wirings).

A shape of the spacers is not limited to the plate shape shown in FIGS. 1 and 2. For example, the shape of the spacers may be a cylinder shape. The thickness of the plate-shaped spacers or the diameter of the columnar-shaped spacers may be sufficiently shorter than a width (pitch) between the phosphor layers.

The number of the spacers is not limited to four. The number of the spacers is determined by their material and shape. A longitudinal direction of the plate-shaped spacers may not be the horizontal direction on the screen as shown in FIG. 1, but may be the vertical direction on the screen.

The material of the spacers is preferably an insulator or a high-resistance body. When the spacers are constituted of the insulators, the surface of the spacers is preferably coated with a high-resistance material.

Figure 11:
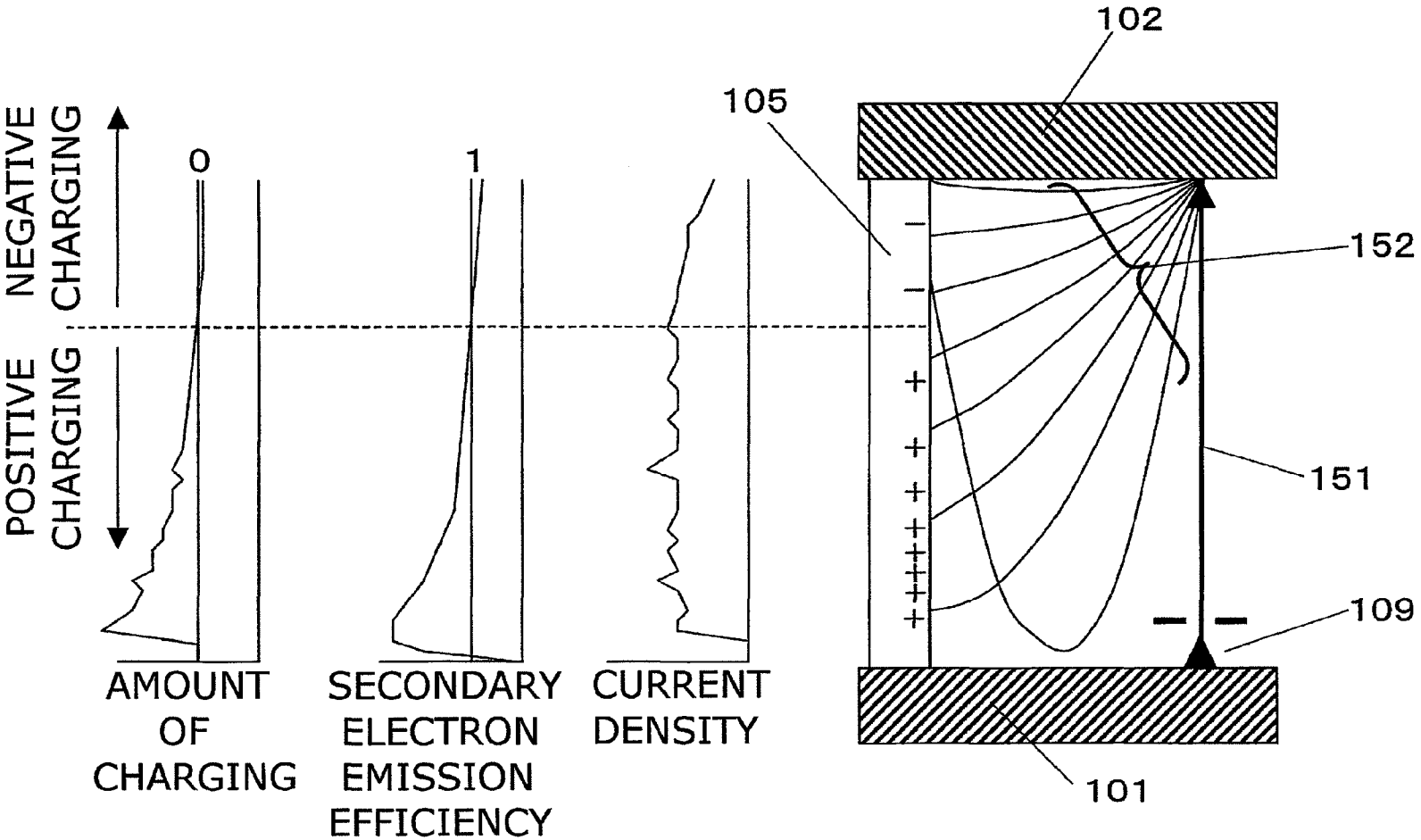
FIG. 11 is a diagram illustrating a charged state of a surface of a spacer.

Concretely, some of the electrons emitted from the electron sources occasionally scatter backward due to the metal back layer and atomic nuclei in the phosphor in an elastic manner. The electrons, which are emitted from the electron sources positioned in distances separated from the provided position of the spacers by within two times as large as the height of the spacers (distance between the face plate and the rear plate), finally fly to the surfaces of the spacers. As a result, the surfaces of the spacers are charged. This state is shown in FIG. 11. A charging amount of the spacers depends on secondary electron emission efficiency distribution of the surface of the spacer and density (current density) distribution of flying electrons to the spacers. Concretely, the charging amount of the spacers is approximately proportional to a product of a value obtained by subtracting 1 from the secondary electron emission efficiency and the flying electron density (current density). For this reason, the charge distribution on the surface of the spacer becomes nonuniform, and the electric field near the spacers is distorted. The distortion of the electric field influences an electron orbit near the spacers and the emission efficiency of the electron sources near the spacers.

Therefore, the surface of the spacer preferably has low resistance in order to prevent the distortion of the electric field due to accumulation of electrification charges on the surface of the spacer. However, since a strong electric field is generated between the face plate and the rear plate, the low-resistance spacers generate excess Joule heat, and thus a defect due to such heat generation is easily caused. For this reason, it is preferable that when the spacers are constituted of the insulators, the surface of the spacer is coated with the high-resistance material. The resistance value of the spacers (or the resistance value of the high-resistance material with which the surface of the spacer is coated) is preferably determined based on an ability to remove electricity of the electrification charges or power consumption (the strength of the electric field generated between the face plate and the rear plate).

In order to repress the charging on the surface of the spacer, different kinds of materials are preferably combined so that the secondary electron emission efficiency on the surface of the spacer is always 1. A very small convexo-concave structure may be provided to a portion which is positively charged. As a result, even when the secondary electron emission efficiency is high, the flying electrons are trapped in the concave portion, and thus the effective secondary electron emission efficiency can be reduced.

The resistance and the shape of the spacers are preferably designed so that the distortion of the electric field near the spacers due to voltage drop distribution (charging amount distribution) caused by the electric current flowing in the spacers and the resistance distribution on the surface of the spacer becomes minimum.

(Constitutions of the Driving Circuits and the Control System)

Constitutions of the driving circuits (X driver 106 and the Y driver 104) and their control systems (respective components on the control substrate 122) are described below. A case where the display panel is driven in a line-sequential manner is described.

Every time the Y driver receives a horizontal synchronization signal after receiving a vertical synchronization signal in each frame, it sequentially shifts the scanning wirings to which a selection voltage is applied. Every time the X driver receives the horizontal synchronization signal, it applies a pulse signal (selection voltage) for image display to each signal wiring. As a result, the plurality of electron sources on the same scanning wiring is selected simultaneously.

Light-emission intensity of the phosphor layers corresponding to the selected electron sources depends on electron emission amount and emission time from the electron sources. Concretely, the light-emission intensity is determined by a pulse height and a pulse width of the pulse signal to be applied to the electron sources.

Figure 12:
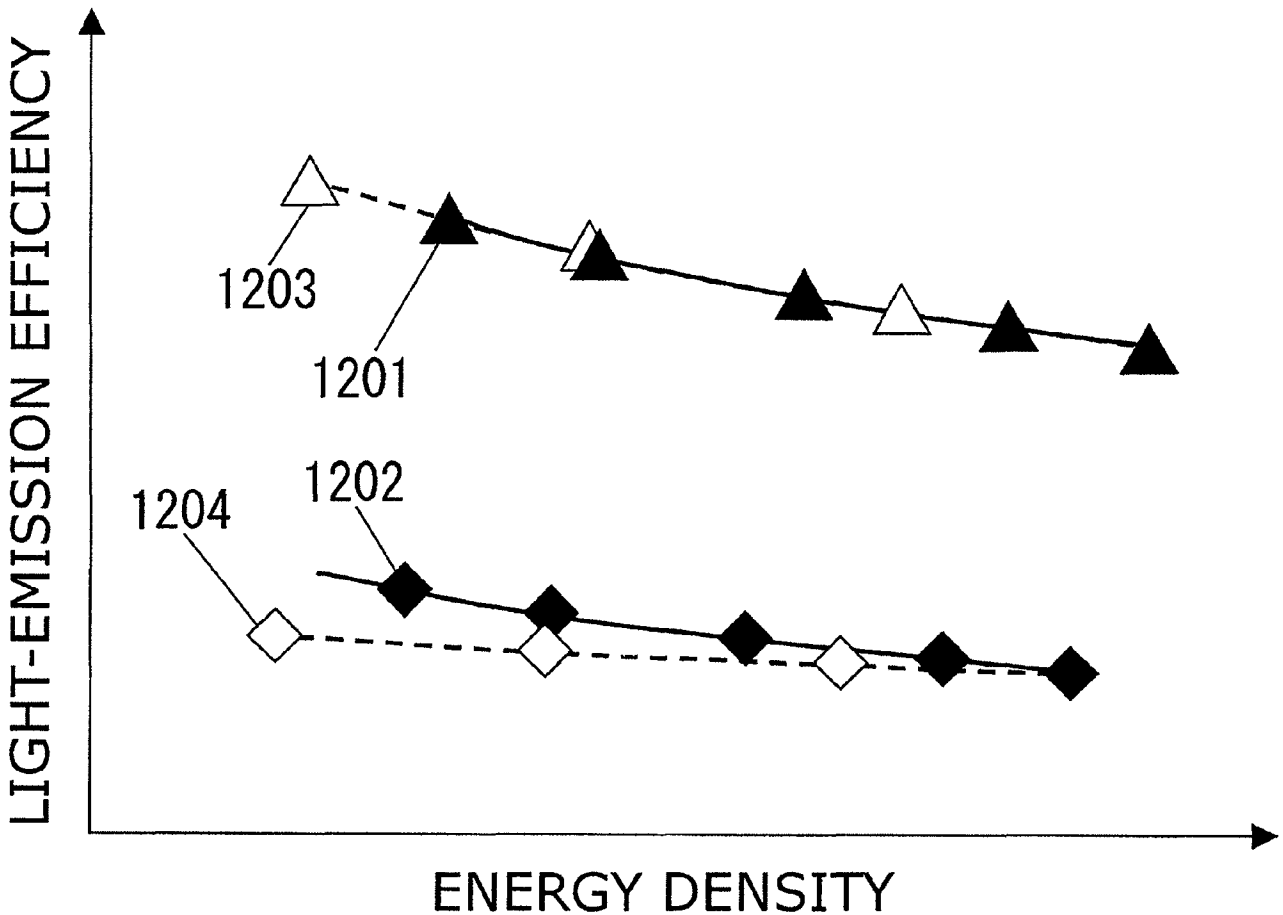
FIG. 12 illustrates one example of a relationship between light-emission efficiency and energy density of a blue phosphor and a red phosphor.

The dependence property of the light-emission intensity with respect to the pulse height and the pulse width varies according to types and excitation conditions of the phosphors. FIG. 12 illustrates a relationship between the light-emission efficiency and the energy density of the blue phosphor ZnS:Ag, Cl and the red phosphor $Y_2O_2S$:Eu. The light-emission efficiency is a ratio of a power which is injected to a unit area of the light-emitting member (total energy of the injected electrons; W) to light flux (lm) emitted from the unit area of the light-emitting member. The energy density is energy in unit area injected into the light-emitting member by one pulse, and is obtained by dividing the product of a potential difference between the face plate and the rear plate, the pulse width and the pulse height by an area of one phosphor layer to which electrons are emitted.

In FIG. 12, black triangles 1201 and black diamonds 1202 represent a change in the light-emission efficiency of the red phosphor $Y_2O_2S$:Eu and the blue phosphor ZnS:Ag, Cl in the case where the pulse width is about 10 microseconds and the energy density is modulated by the pulse height. On the other hand, symbols white triangles 1203 and white diamonds 1204 represent a change in the light-emission efficiency of $Y_2O_2S$:Eu and ZnS:Ag, Cl in the case where the energy density is modulated by the pulse width on the bases of 10 microseconds.

As shown in FIG. 12, in both the cases, the light-emission efficiency reduces due to an increase in the energy density. However, the dependence properties of the light-emission efficiency in $Y_2O_2S$:Eu are equal to each other in the case where the energy density is modulated by the pulse width and in the case where the energy density is modulated by the pulse height, but the dependence properties of the light-emission efficiency in ZnS:Ag, Cl are different from each other. Concretely, the light-emission efficiency in ZnS:Ag, Cl in the case where the energy density is modulated by the pulse height reduces more greatly than the case where the energy density is modulated by the pulse width.

Such difference is generated because the afterglow time of the emitted light (light emission life) in $Y_2O_2S$:Eu is about 100 microseconds, namely, it is sufficiently long with respect to the pulse width, but the light emission life in ZnS system is about 3 microseconds, namely, it is equivalent to the pulse width. Concretely, since the number of carriers (excitable carriers) in a ground state reduces due to the increase in the energy density, the light-emission efficiency reduces. However, when the pulse width is close to the light emission life, the number of carriers to be returned to base order increases according to the increase in the excitation pulse width. For this reason, the above difference is generated.

Therefore, in the display panel, the changes in the light-emission intensity in the cases where the pulse height and the pulse width are modulated can be preferably referred to for each phosphor layer (each sub-pixel). Concretely, software for operating the CPU and correction information may be stored in the flash memory (EEPROM) 113. The CPU 110 corrects (operates) an image input via the I/F 111 based on the correction information temporarily stored in the RAM 112 from the flash memory 113 for high-speed reference, and may output the corrected image to the X driver and the Y driver. The correction information includes information about the light-emission intensity of the phosphors with respect to the pulse height and the pulse width and information for inversely correcting an image with respect to dispersion of the electron emission characteristic of each electron source. The information for inverse correction is a look-up table (LUT) for increasing and decreasing the pulse height and the pulse width by a sub-pixel unit in order to eliminate the dispersion of the light-emission intensity caused by the dispersion of the electron emission characteristic of the electron sources. The dispersion of the light-emission intensity caused by the dispersion of the electron emission characteristic of the electron sources is measured in advance at the time of manufacturing the display panels.

In the image display apparatus to which the present invention can be applied, an image, which includes an influence of irregular light-emission intensity (irregular luminance) among the pixels caused by the dispersion at the time of manufacturing the electron sources, is inversely corrected. As a result, an irregular image and a rough image can be reduced.

The dispersion at the time of manufacturing the electron sources, however, fluctuates due to the long-time operation of the image display apparatus. For this reason, the information for inverse correction (correction information) should be suitably updated. In the image display apparatus according to the embodiment of the present invention, such problem can be solved. The image display apparatus according to the embodiment is described in detail below.

<The Image Display Apparatus according to the Embodiment>

Figure 13:
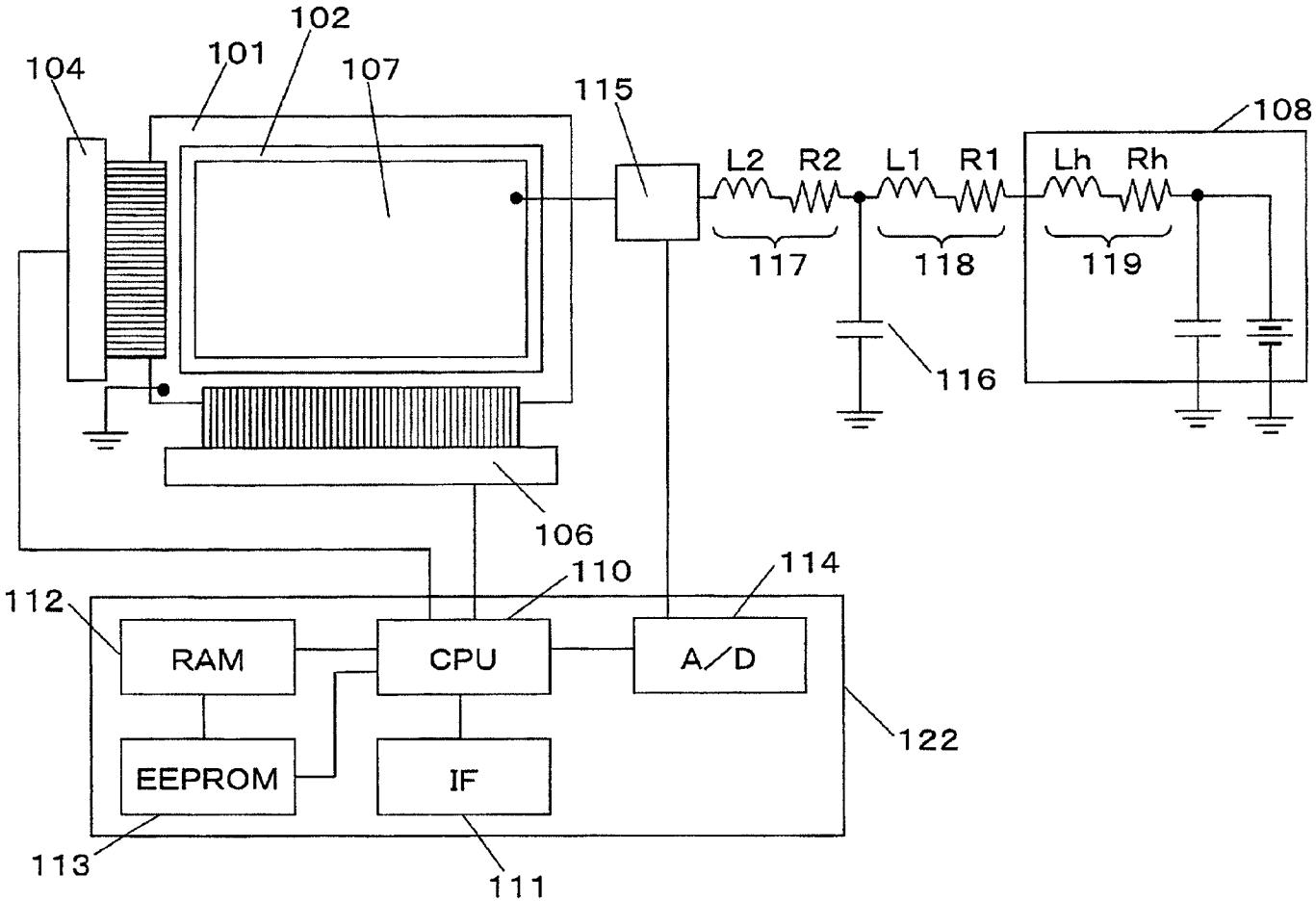
FIG. 13 is a diagram illustrating one example of a constitution of the image display apparatus according to an embodiment.

FIG. 13 is a diagram illustrating the constitution of the image display apparatus according to the embodiment. In the image display apparatus according to the embodiment, an electric current which flows between the electron sources and the light-emitting member (emission current) can be accurately monitored.

In FIG. 13, a high-voltage power source 108 applies a high voltage to the face plate 102 (concretely, the light-emitting member 107) (generates a strong electric field between the face plate 102 and the rear plate 101 (the light-emitting member 107 and the electron sources 109). The value of the high voltage falls within a range of a few kV to a several dozen kV, and is preferably kept constant.

Reference numeral 119 represents a resistance value Rh and inductance Lh in the high-voltage power source (output portion). Rh and Lh can be measured by setting the high-voltage power source to a non-operation state, and connecting an impedance analyzer between an output portion on a high voltage side of the high-voltage power source and an output portion on a low voltage side (in the drawing, on a Gnd side of the high-voltage power source).

A current detector 115 is connected between the light-emitting member 107 and the high-voltage power source 108 in order to detect the emission current from the electron-emitting devices. A provided position of the current detector 115 is preferably a position which is as close as possible to the face plate (light-emitting member). As a result, an influence of a parasitic capacity component on the high-voltage wirings (wirings which connect the high-voltage power source 108 and the light-emitting member 107) can be avoided. A differential-type current detector such as an isolation amplifier or a derivative-type current detector such as a current transformer or a magneto-resistive element can be suitably used as the current detector 115. The current detector 115 may be arranged on the low-voltage output side (ground side) of the high-voltage power source. In this case, the electric current for driving the high-voltage power source should be also monitored. Further, the entire high-voltage power source needs to be electro-magnetically shielded in some cases.

The current detector 115 is connected to an analog-digital (A/D) converter 114 connected to the CPU on the control substrate 122. The A/D converter 114 discretely samples a detected waveform in the current detector 115 so as to convert it into a digital signal and sends it to the CPU. A voltage amplifier may be provided between the current detector 115 and the A/D converter 114. When the CPU 110 has an A/D converting function, the A/D converter 114 may be omitted.

The CPU 110 controls a voltage to be applied to the electron-emitting devices (the voltage to be applied to the scanning wirings and the signal wirings) based on the detection result in the current detector 115. In this embodiment, when the electric current detected by the current detector 115 fluctuates, the pulse width is adjusted by the fluctuation by using a relationship between pulse width dependence and current dependence of the light-emission efficiency measured in advance. As a result, the emission characteristic of the electron-emitting devices is compensated.

A bypass capacitor 116 is provided. One end of the bypass capacitor is connected between the high-voltage power source 108 and the current detector 115, and the other end is connected to a potential regulating electrode. An electric potential of the potential regulating electrode is equal to the electric potential of the rear plate 101. The electric current flowing between the electron sources and the light-emitting member is detected generally by flowing charges accumulated on the display panel to the current detector 115. For this reason, time delays at the time of the detection, and thus a waveform of the detected current is distorted. In the embodiment, the bypass capacitor 116 is provided so as to be capable of supplying the electric current flowing in the current detector 115 from the bypass capacitor side. By this way, the distortion of the waveform can be prevented.

Reference numeral 118 represents a resistor with resistance value R1 and an inductor with inductance L1 provided in series between the bypass capacitor and the high-voltage power source. Reference numeral 117 represents a resistor with resistance value R2 and an inductor with inductance L2 provided in series between the bypass capacitor and the current detector.

One example of the result of detecting the electric current by means of the current detector 115 is described with reference to FIG. 14. The value of the electric current shown in FIG. 14 (vertical axis) is obtained in such a manner that the A/D converter 114 samples the electric current detected at the time of driving only the electron sources on one scanning wiring.

Figure 14:
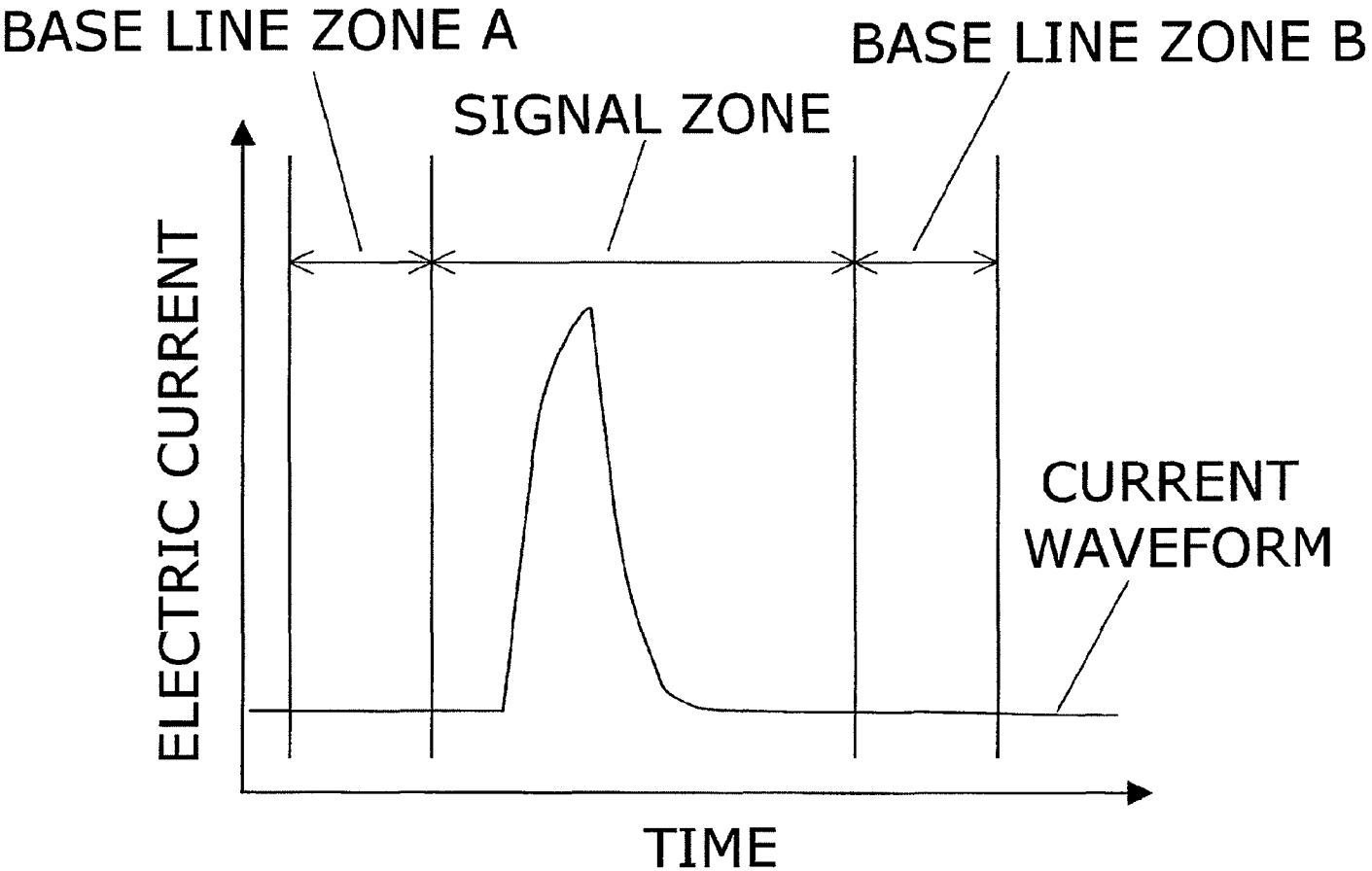
FIG. 14 is a diagram illustrating one example of a result of detecting an electric current by means of a current detector.

In FIG. 14, a zone preceding a rising edge of the current waveform is a base line zone A, and a zone after a trailing edge of the current waveform (a zone after the time point at which the current value reaches a level equivalent to the base line zone A) is a base line zone B. A zone between the base line zone A and the base line zone B, namely, a zone including an electric current detected by driving the electron sources is a signal zone. Average values of the electric current in the signal zone, the base line zone A and the base line zone B are S, B1 and B2, respectively. The electric current flowing between the electron sources and the light-emitting member (an amount of electrons colliding with the light-emitting member; panel current; emission current) can be expressed by S−(B1+B2)/2. This value is successively measured as the driving time of the display panel passes, so that the fluctuation in the panel current (emission current) can be monitored. Time from the peak position of the detected current to the base line zone B (relaxation time) depends on the resistors and the inductors connected on the high-voltage wirings, the resistor among the pixels of the light-emitting member (among the phosphor layers), and the capacitance between the face plate and the rear plate (electrostatic capacitance; panel capacitance). The relaxation time up to the base line zone B is relaxation time of the trailing edge of the current waveform, and for example, time from the peak of the waveform to the base line zone B. In this description, the time from the peak to the base line zone B is regarded as the relaxation time, but similarly, a half of the time from the peak to the base line or 1/10 of the time can be used.

In this embodiment, the electrostatic capacitance Cp of the bypass capacitor is set to follows:

$$Cp > C_panel = \in A/d.$$

$\in$ is permittivity of vacuum, A is an area of an image display section (light-emitting member), d is a distance between the face plate and the rear plate, and C_panel is panel capacitance. Cp is preferably 10 times as large as C_panel or more. The reason for this is described below.

Figure 15:
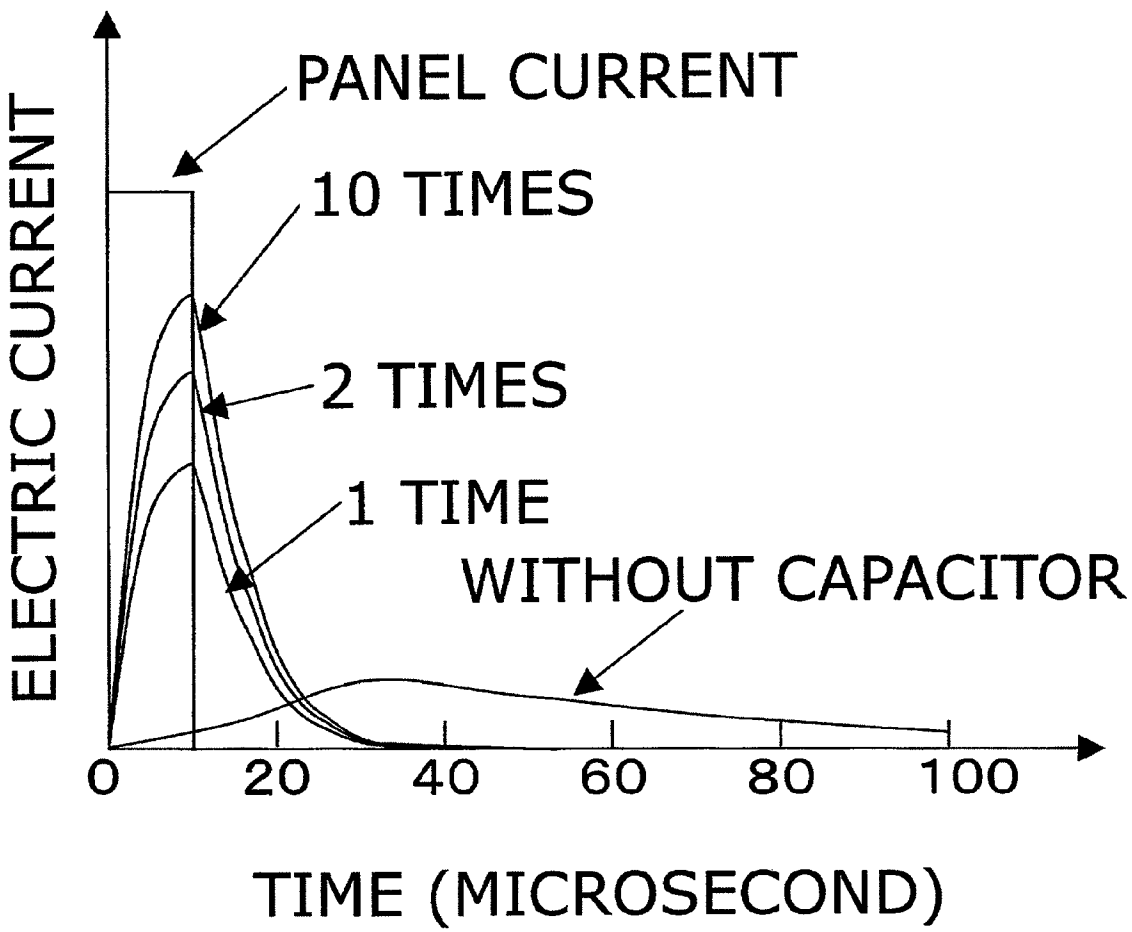
FIG. 15 is a diagram illustrating a panel current at the time of driving an electron source on one scanning wiring and an electric current detected by the current detector at that time.

FIG. 15 is a diagram illustrating a panel current at the time of driving the electron sources on one scanning wiring (an electric current of a rectangular waveform in FIG. 15) and an electric current detected by the current detector at this time (detection result). FIG. 15 illustrates the results in the case where the capacitance of the bypass capacitor is 10 times, 2 times, 1 times and 0 times (no bypass capacitor) as large as the panel capacitance as the detection results. The detection results shown in FIG. 15 are results in the case where the output voltage from the high-voltage power source has no noise component (an amplitude of a ripple component is 0), a resistor of 1 kΩ is provided between the high-voltage terminal (terminal connected to the high-voltage wiring) and the light-emitting member on the face plate, and the panel capacitance is 5 nF.

As is clear from FIG. 15, the amplitude of the electric current (current waveform) detected by the current detector (for example, the maximum value−the minimum value of the waveform) depends on the capacitance of the bypass capacitor. When the capacitance of the bypass capacitor is equal to the panel capacitance (one time), its amplitude becomes about half of the panel current. This is because in the case of "one time", about half of the panel current is generated by the flowing of the electric charges accumulated on the display panel, and the residual half is generated by the electric current of the bypass capacitor. When the capacitance Cp of the bypass capacitor is smaller than the one time of the panel capacitance, the amplitude of the electric current flowing in the current detector abruptly reduces, and the rising of the waveform becomes slow. That is to say, distortion of the waveform increases. For this reason, the electrostatic capacitance Cp of the bypass capacitor is made to be larger than the panel capacitance.

An effect of the provision of the bypass capacitor (improving effect of the current detecting accuracy) is described with reference to FIG. 16.

In general, the high-voltage power source heightens an alternating voltage of a pulse waveform or a sine waveform by means of a winding transformer or a dielectric transformer and rectifies it by means of a rectifying circuit. For this reason, a ripple noise which synchronizes with an oscillation frequency of the pulse or sine wave is easily generated. Particularly in the small high-voltage power source which can be mounted to the image display apparatus, repression of a ripple noise becomes extremely difficult in some cases due to limitation of the size of the rectifying circuit.

Figure 16:
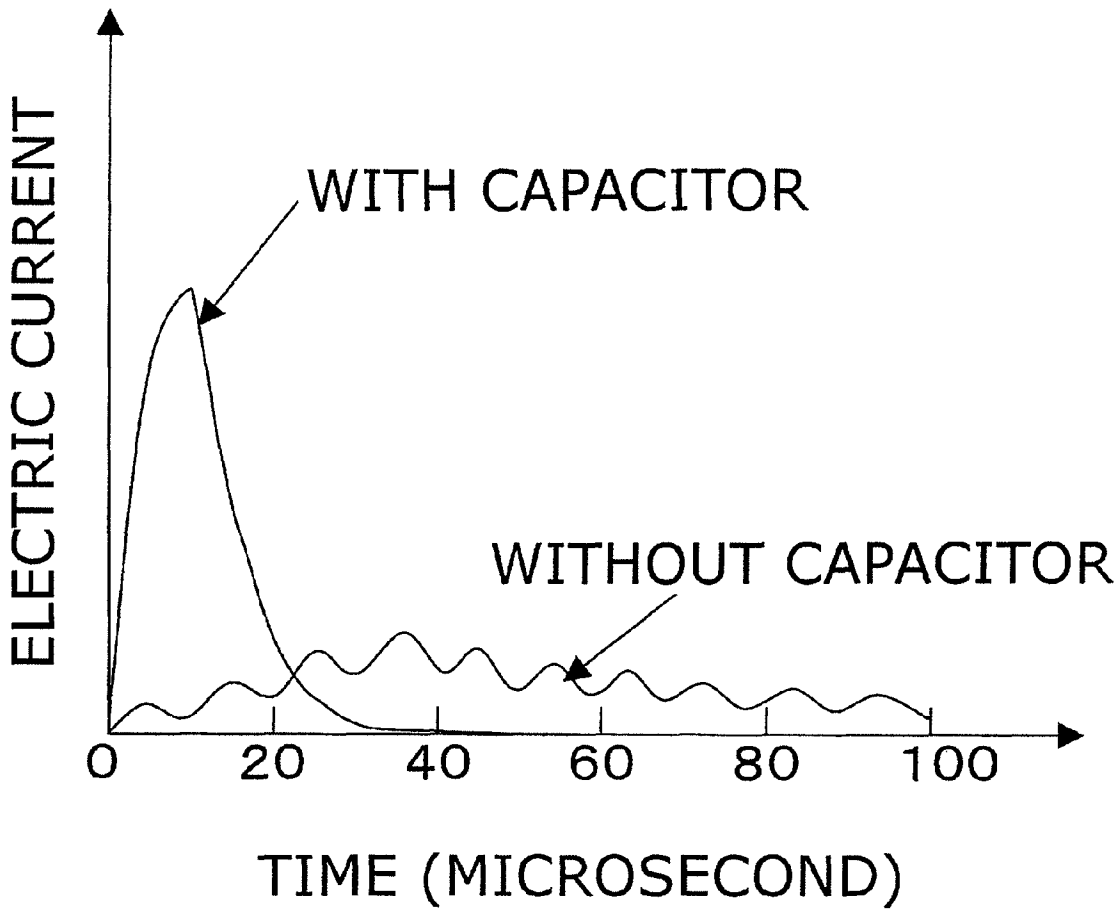
FIG. 16 is a diagram illustrating a detection result by means of the current detector when a noise component is present in an output voltage from the high-voltage power source.

FIG. 16 illustrates detection results by the current detector in the case where a noise component (ripple component; ripple noise) is present in the output voltage from the high-voltage power source. FIG. 16 illustrates a difference in the detection results between presence and absence of the bypass capacitor. When the bypass capacitor is not provided, the current waveform of the detection result has an oscillation component caused by ripple noise. On the other hand, when the bypass capacitor is provided, the amplitude of the oscillation component is repressed. This is because the ripple noise generated in the high-voltage power source is absorbed by the bypass capacitor.

Therefore, when the bypass capacitor whose capacitance is larger than the panel capacitance is provided, a reduction in the amplitude of the panel current waveform detectable by the current detector can be repressed, and the influence of the ripple noise generated in the high-voltage power source can be repressed. Therefore, an S/N ratio of the detected current can be improved, so that the panel current can be accurately monitored.

In this embodiment, the influence of the ripple noise can be further repressed by providing the resistors and the inductors 117 and 118.

Figure 17:
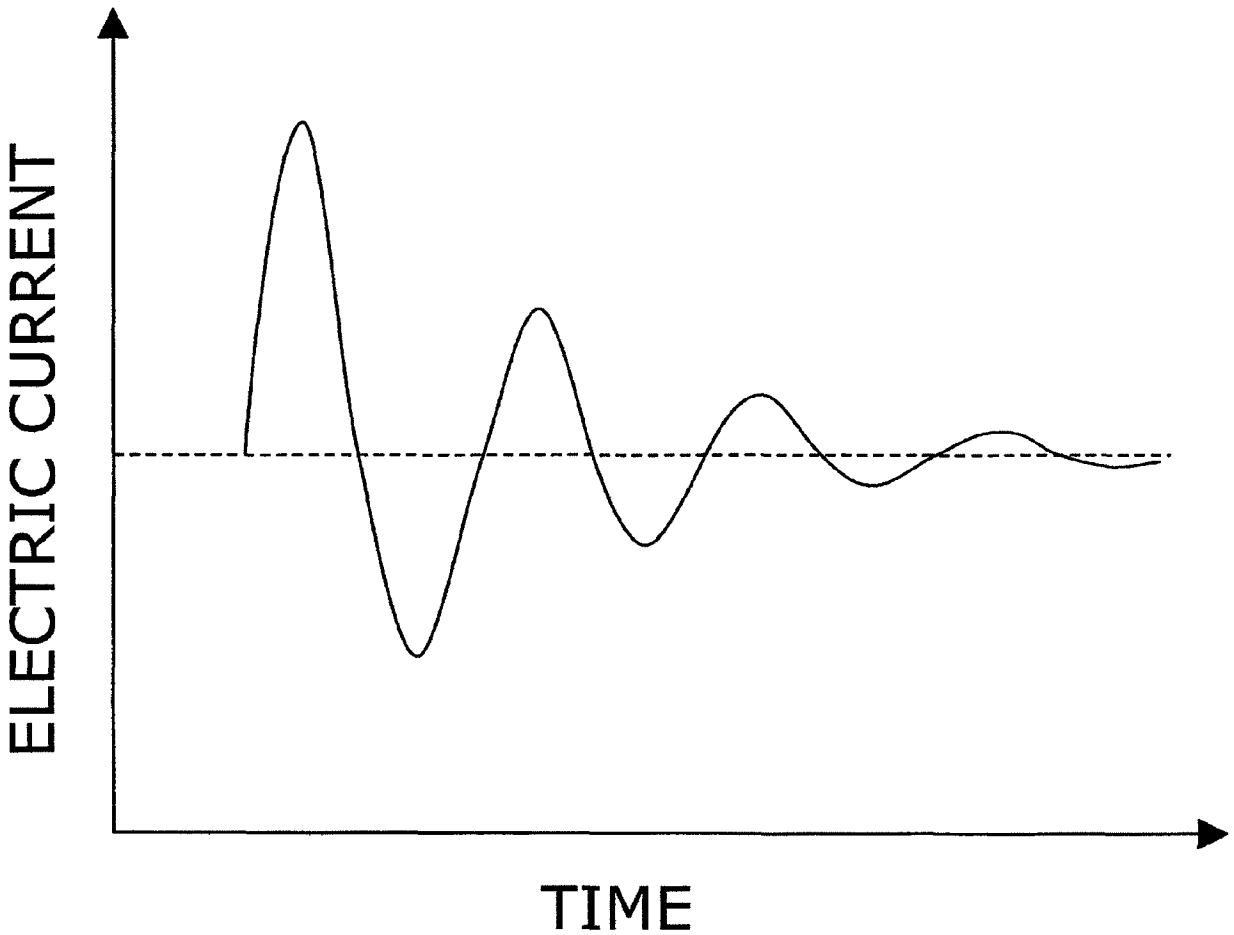
FIG. 17 is a diagram illustrating oscillation of an electric current originated by coupling of an inductance component and a capacitance component.

Concretely, when the oscillation frequency of ripple noise is ω, the repressing effect of the ripple noise influence is proportional to $(((\omega(L1+Lh))^2+(R1+Rh)^2)\times((\omega L2)^2+R2^2))^{0.5}$. However, the electric current flowing between the high-voltage power source and the face plate occasionally oscillates due to coupling of an inductance component and a capacitance component (FIG. 17). This oscillation becomes a noise in the current measurement. In order to repress such oscillation, the resistance values R1 and R2 and the inductances L1 and L2 preferably satisfy the following relationship:

$$(R1+Rh) > 2((L1+Lh)/Cp)^{1/2}$$

$$R2 > 2(L2/(\in A/d))^{1/2}$$

Figure 18:
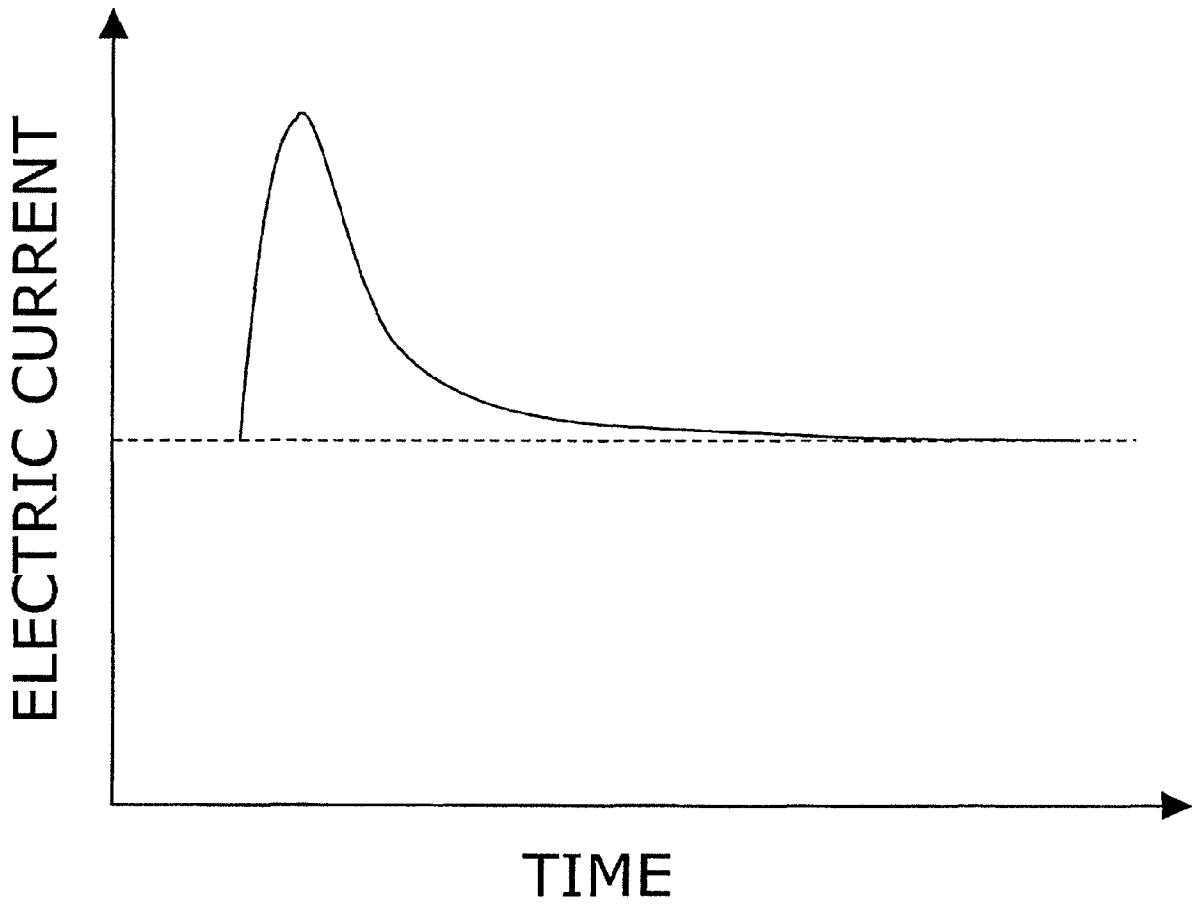
FIG. 18 is a diagram illustrating a current waveform when the oscillation of the electric current originated by coupling of the inductance component and the capacitance component is repressed.

When such a relationship is satisfied, a signal (electric current) of a waveform shown in FIG. 18 can be detected.

An example of the current detecting method in the image display apparatus according to the embodiment is described below. In this embodiment, the electric current is detected for R color, G color and B color (each plain color).

Figure 19:
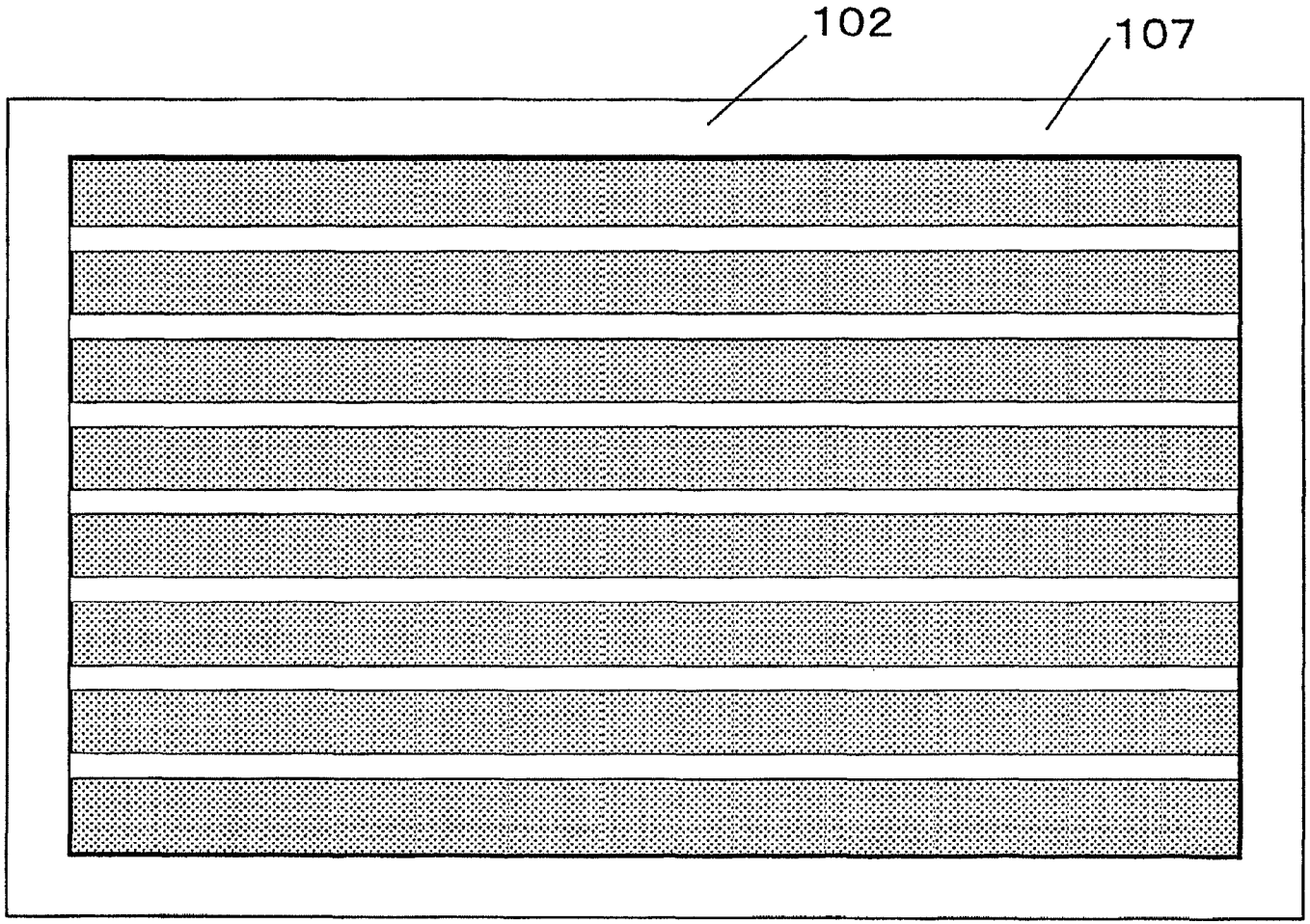
FIG. 19 is a diagram illustrating one example of a pattern displayed at the time of measuring the electric current.

In order to measure the emission current on each scanning wiring with high accuracy, the electric current to be detected can be preferably separated according to each scanning wiring. In this embodiment, therefore, the current detector detects an electric current when a striped pattern (image) shown in FIG. 19 is displayed by line-sequential driving. Concretely, the striped pattern is such that lighted areas (the areas where the driven electron-emitting devices are arranged) and unlighted areas (the areas where the electron-emitting devices other than the ones on the lighted area are arranged) are arranged in a scanning direction alternately. A width of the lighted area corresponds to one scanning wiring. A plurality of patterns where positions of the lighted areas in the scanning direction are different from each other is sequentially displayed, so that respective electric currents corresponding to the plurality of scanning wirings are detected. The positions of the lighted areas in the scanning direction are shifted to positions of adjacent scanning wiring so that the patterns are displayed at a plurality of times.

As a result, the fluctuation in the emission current (emission characteristic of the electron-emitting device) on each scanning wiring can be compensated. Respective electric currents corresponding to the plurality of scanning wirings can be temporally separated, so that respective electric currents corresponding to the plurality of scanning wirings can be accurately measured by one-time measurement. Further, the emission current of each scanning wiring can be measured in short time. For example, when the number of scanning wirings is 1080, a measurement of the electric current of each the scanning wiring should be measured 1080 times. In this case, when the above pattern such that the width of unlighted area corresponds to 30 scanning wirings is used, the measurement is taken only 31 (=30+1) times.

Figure 20:
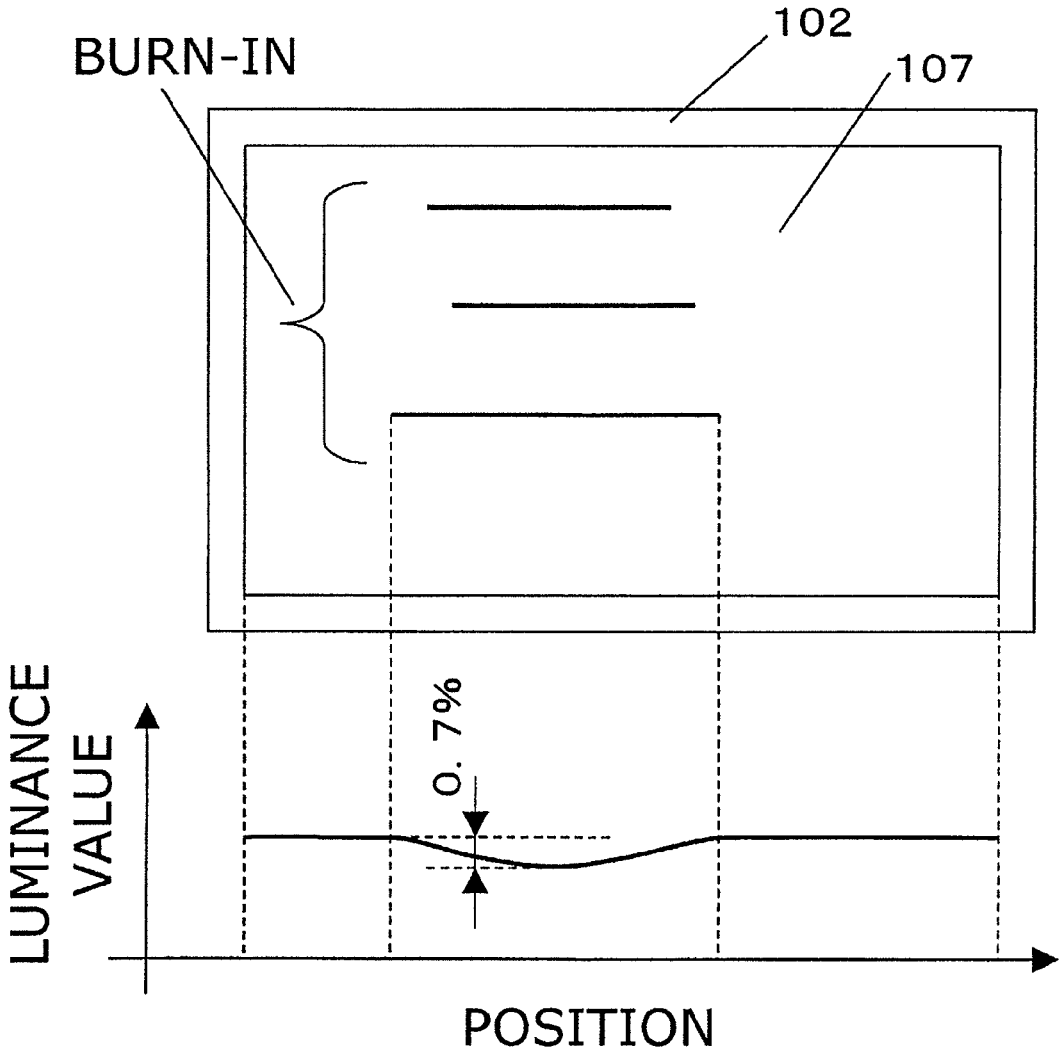

The width of the unlighted area between the first lighted area and the second lighted area is preferably set so that after the electric current to be detected at the time of driving the electron-emitting devices corresponding to the first lighted area is returned to a basal value, the electron-emitting devices corresponding to the second lighted area are driven. The first lighted area and the second lighted area are two lighted areas which sandwich one unlighted area. As a result, respective electric currents corresponding to the plurality of scanning wirings can be securely separated. Concretely, the number or more of scanning wirings which is obtained by dividing the relaxation time of the detected current by selection time of one scanning wiring (inverse number of a horizontal synchronization frequency) may be a basal value. For example, the driving frequency of the panel is 60 Hz, the number of scanning wirings is 1080, and the relaxation time is 300 microseconds. When the selection time of one scanning wiring is about 15 microseconds, the relaxation time of 300 microseconds corresponds to 20 scanning wirings (=300/15). For this reason, the width of the unlighted area is determined based on the 20 scanning wirings. Concretely, 20 or more (for example, 30) scanning wirings are set after a slight allowance is taken into consideration When the image display apparatus adopting the line-sequential driving system is driven for long time (entire screen (surface where a video is displayed: display area) is continuously displayed with white), streaky burn-in which extends to the horizontal direction on the screen as shown in FIG. 20 occasionally occurs. The reason for this is a fluctuation in secondary electron emission efficiency on the surface of the spacer due to the long-time emission of scattered electrons on the light-emitting member to the spacer, a fluctuation in the output resistance of the X driver, or a fluctuation in the emission characteristic of the electron-emitting devices on each scanning wiring.

The burn-in occurs due to a continuous change (reduction) in luminance value from the both ends towards the center on one scanning wiring as shown in FIG. 20. Concretely, when a difference between the maximum value and the minimum value of the luminance value is larger than about 0.7% in such change, "the burn-in" gives discomfort feeling to users.

Figure 21:
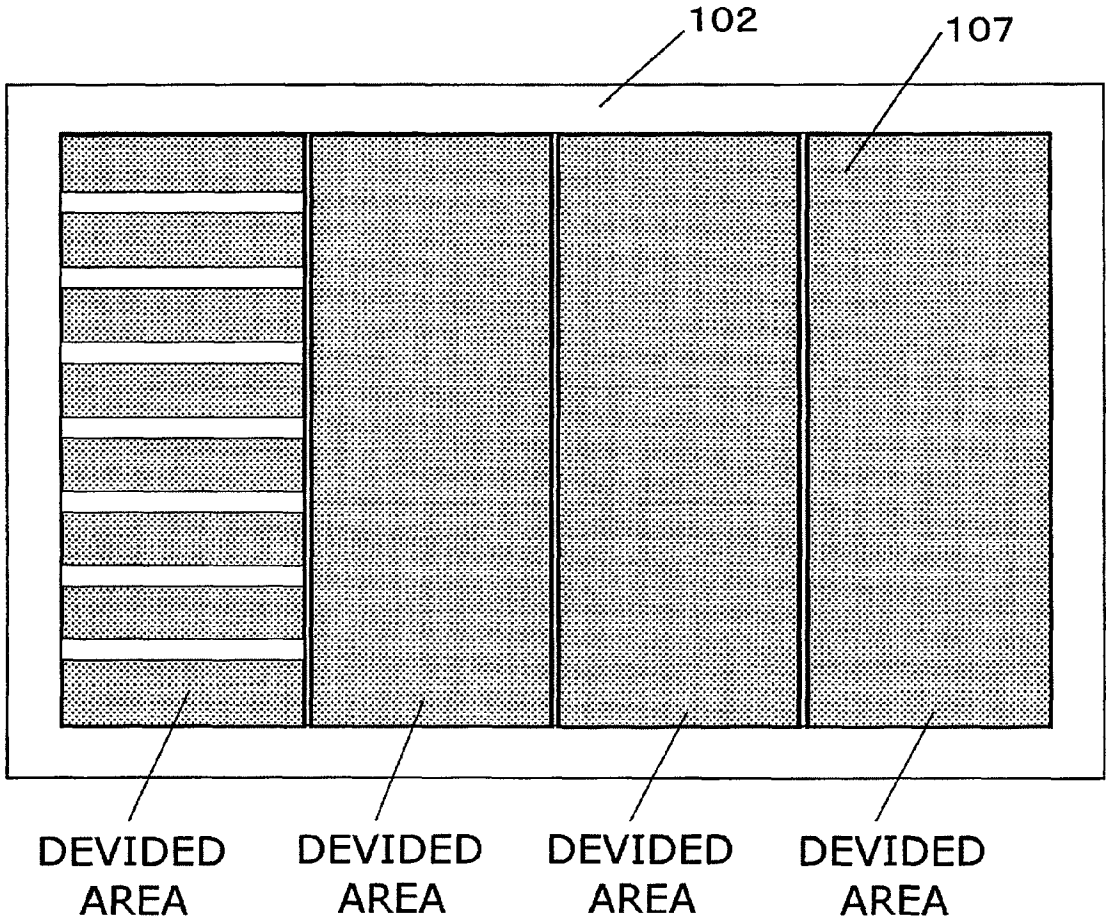
FIG. 21 is a diagram illustrating one example of a pattern displayed at the time of measuring the electric current.

In this embodiment, therefore, the scanning wirings are divided into a plurality of segments in their lengthwise direction. The lighted area has a length corresponding to one segment. The current detector sequentially displays a plurality of patterns where the positions of the lighted areas in the lengthwise direction are different from each other so as to detect respective electric currents corresponding to the plurality of segments on the scanning wirings. As a result, the emission characteristic of the electron-emitting devices can be compensated not only in the vertical direction (scanning direction) but also in the horizontal direction on the screen. FIG. 21 illustrates an example of the case where the scanning wirings are divided into four segments in the lengthwise direction (horizontal direction) and the positions of the lighted areas in the lengthwise direction in one pattern are equal to each other.

In actual measurement, all the positions of the lighted areas in the lengthwise direction in one pattern are equal to each other, and all the patterns where the positions of the lighted areas in the lengthwise direction are equal to each other are sequentially displayed. One pattern is displayed by line-sequential driving. Concretely, one pattern is lighted five times by using the same frequency as a frequency at the time of normal image display. The lightening is performed similarly on the other scanning wirings (when the width of the unlighted area corresponds to 30 scanning wirings, the lightening is performed on 31 scanning wirings). The A/D converter samples a current value detected (measured) in the display at a rate which is four times (the number of segments) as high as the horizontal synchronization frequency so as to temporarily record it in the RAM 112. The CPU 110 calculates the panel current (or a value corresponding to the panel current) based on the recorded current value (current waveform) so as to store it in the RAM 112. For example, an area, in which the panel current of the divided area is stored is predetermined in the RAM 112, and the calculated panel current is written into this storage area.

After the measurement (detection) on the position of one lighted area is completed, the positions of the lighted areas in the lengthwise direction are switched and the same process is executed. For example, the positions of the lighted area in the lengthwise direction are sequentially switched into positions of the adjacent segments. That is to say, the switching is performed at the same number of times as the number of segments. When the display of all the patterns is finished, the measurement is completed. The CPU 110 controls voltages to be applied to the scanning wirings and the signal wirings according to preset software (firmware). Concretely, the CPU 110 compares the measured and recorded panel current with an initial value stored in advance, so as to determine the pulse width. The CPU 110 rewrites the look-up table LUT for correcting dispersion of the emission characteristic of the electron-emitting devices. The firmware is stored in the flash memory 113.

The current fluctuation is compensated by the pulse width with reference to the previously measured light-emission efficiency dependence property on the electric current and the pulse width in each phosphor. On the lengthwise center portions of the respective lighted areas, an average value of the lighted areas may be used and the fluctuation in the electric current between the lighted areas (adjacent in the lengthwise direction) may be interpolated by their average value on the respective areas so as to be used. Fitting using a bezier curve or polynomial equation can be used for interpolation. In the above measurement, images are displayed for each lighted area with horizontal stripes of the single RGB colors being scrolled in the vertical direction. In the example of this embodiment, total lighting time of the images is about 30 seconds.

This measurement may be taken when the operation of the image display apparatus is ended. At the time of the end of the operation, the measurement can be taken without giving discomfort feeling to the users. The measurement does not have to be taken every time the operation of the image display apparatus is ended. For example, the measurement may be taken every time which is shorter than the time for which discomfort streaky burn-in occurs. The firmware may have a timer function for taking the measurement on a basis of once in 3000 hours, for example. That is to say, only when the operation is ended after the lighting time of the image display apparatus is integral multiples of 3000 hours, the measurement may be taken. Before the measurement, screen representing that a measurement screen (screen at the time of the measurement) is displayed may be displayed. As a result, the user's risk of erroneously determining the measurement screen as a failure of the image display apparatus is eliminated. Only when the user accepts the measurement, the measurement may be taken. As a result, the emission characteristic of the electron-emitting devices is corrected according to user's intention. When the power fails while the look-up table LUT is being updated, the correction table before rewriting is saved, and the measurement operation may be set to be taken again at a next operation.

In order to reduce the discomfort feeling to the user due to the current measurement, a function for providing a pseudogray scale pattern may be incorporated into the firmware. For example, the display order of the lighted areas is randomized in the vertical and horizontal directions on the screen and between display colors RGB. In this case, since the current waveforms of the entire screen should be once stored in RAM, a large capacity of RAM is necessary. For this reason, trade-off problem such that the cost of the control substrate is slightly heightened arises.

In the image display apparatus according to the embodiment, the fluctuation in the panel current can be accurately estimated. The voltage to be applied to the electron-emitting devices is controlled according to the fluctuation, so that deterioration in image quality can be sufficiently repressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-177781, filed on Jul. 8, 2008, which is hereby incorporated by reference herein in its entirety.

What is claimed is:

1. An image display apparatus, comprising:

a rear plate which has a plurality of scanning wirings and a plurality of signal wirings arranged in a matrix and a plurality of electron-emitting devices arranged respectively at intersection points of the scanning wirings and the signal wirings;

a face plate which has a light-emitting member for emitting light due to collision of electrons;

a high-voltage power source which applies a high voltage to the light-emitting member;

a current detecting unit which is connected between the light-emitting member and the high-voltage power source in order to detect an emission current from the electron-emitting devices;

a control unit which controls a voltage to be applied to the electron-emitting devices based on detection result of the current detecting unit; and a bypass capacitor, wherein one end of the bypass capacitor is connected between the high-voltage power source and the current detecting unit, and the other end of the bypass capacitor is connected to a potential regulating electrode, wherein an electrostatic capacitance Cp of the bypass capacitor satisfies a following formula:

$$Cp>\in A/d$$

where $\in$: permittivity of vacuum,

A: an area of the light-emitting member, and d: a distance between the rear plate and the face plate.

2. An image display apparatus according to claim 1, wherein a resistor with resistance value R1 and an inductor with inductance L1 are provided in series between the bypass capacitor and the high-voltage power source, R1 and L1 satisfying a following formula:

$$(R1+Rh)>2((L1+Lh)/Cp)^{1/2}$$

where Rh and Lh are a resistance value and inductance in the high-voltage power source, respectively, a resistor with resistance value R2 and an inductor with inductance L2 are provided in series between the bypass capacitor and the current detecting unit, R2 and L2 satisfying a following formula:

$$R2>2(L2/(\in A/d))^{1/2}.$$

3. An image display apparatus according to claim 1, wherein the current detecting unit detects an electric current which flows when a striped pattern where lighted areas having a width corresponding to one scanning wiring and unlighted areas are arranged alternately in a scanning direction is displayed by line-sequential driving, a plurality of patterns where positions of the lighted areas in the scanning direction are different from each other is sequentially displayed, so that respective electric currents corresponding to the plurality of scanning wirings are detected.

4. An image display apparatus according to claim 3, wherein the scanning wiring is divided into a plurality of segments in its lengthwise direction, the lighted area has a length corresponding to one segment, a plurality of patterns where positions of the lighted areas in the lengthwise direction are different from each other is sequentially displayed, so that respective electric currents corresponding to the plurality of segments of the scanning wirings are detected.

5. An image display apparatus according to claim 3, wherein a width of an unlighted area between a first lighted area and a second lighted area is set so that after the electric current detected at time of driving the electron-emitting devices corresponding to the first lighted area returns to a basal value, the electron-emitting devices corresponding to the second lighted area are driven.

6. An image display apparatus according to claim 1, wherein the electron-emitting device is a surface conduction electron-emitting device.

* * * * *